US009732565B2

(12) United States Patent
Roodenburg et al.

(10) Patent No.: US 9,732,565 B2
(45) Date of Patent: Aug. 15, 2017

(54) METHOD FOR RISER STRING HANDLING AND AN OFFSHORE DRILLING VESSEL

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/123,530

(22) PCT Filed: Mar. 2, 2015

(86) PCT No.: PCT/EP2015/054305

§ 371 (c)(1),
(2) Date: Sep. 2, 2016

(87) PCT Pub. No.: WO2015/132202

PCT Pub. Date: Sep. 11, 2015

(65) Prior Publication Data

US 2017/0074049 A1 Mar. 16, 2017

(30) Foreign Application Priority Data

Mar. 3, 2014 (NL) ..... 2012349

(51) Int. Cl.
*E21B 17/01* (2006.01)
*B63B 35/44* (2006.01)
(Continued)

(52) U.S. Cl.
CPC ..... *E21B 17/012* (2013.01); *B63B 1/107* (2013.01); *B63B 27/04* (2013.01); *B63B 29/02* (2013.01);
(Continued)

(58) Field of Classification Search
CPC ..... E21B 7/128; E21B 15/02; E21B 17/012; E21B 17/07; E21B 19/002; E21B 19/004;
(Continued)

(56) References Cited

U.S. PATENT DOCUMENTS 6,321,675 B1 * 11/2001 Dybdahl ..... B63B 35/4413 114/264
6,361,262 B1 * 3/2002 Roodenburg ..... E21B 19/143 166/77.51
(Continued)

FOREIGN PATENT DOCUMENTS

WO WO 02/18742 A1 3/2002
WO WO 2009/102196 A2 8/2009
(Continued)

*Primary Examiner* — Matthew R Buck

(74) *Attorney, Agent, or Firm* — Birch, Stewart, Kolasch & Birch, LLP

(57) ABSTRACT

A method for riser string handling on an offshore drilling vessel, the offshore drilling vessel including a multiple firing line hoist system, a riser tensioner system arranged in the second firing line, and a suspended riser transfer device. The method including the steps of lowering a riser string in the first firing line, and simultaneously assembling and preparing a riser tensioner system in the second firing line, wherein the riser hang-off assembly displaces the riser string, leaving the top end of the riser string exposed, from the first firing line to the second firing line to be connected to the riser tensioner system.

6 Claims, 20 Drawing Sheets

Figure 1:
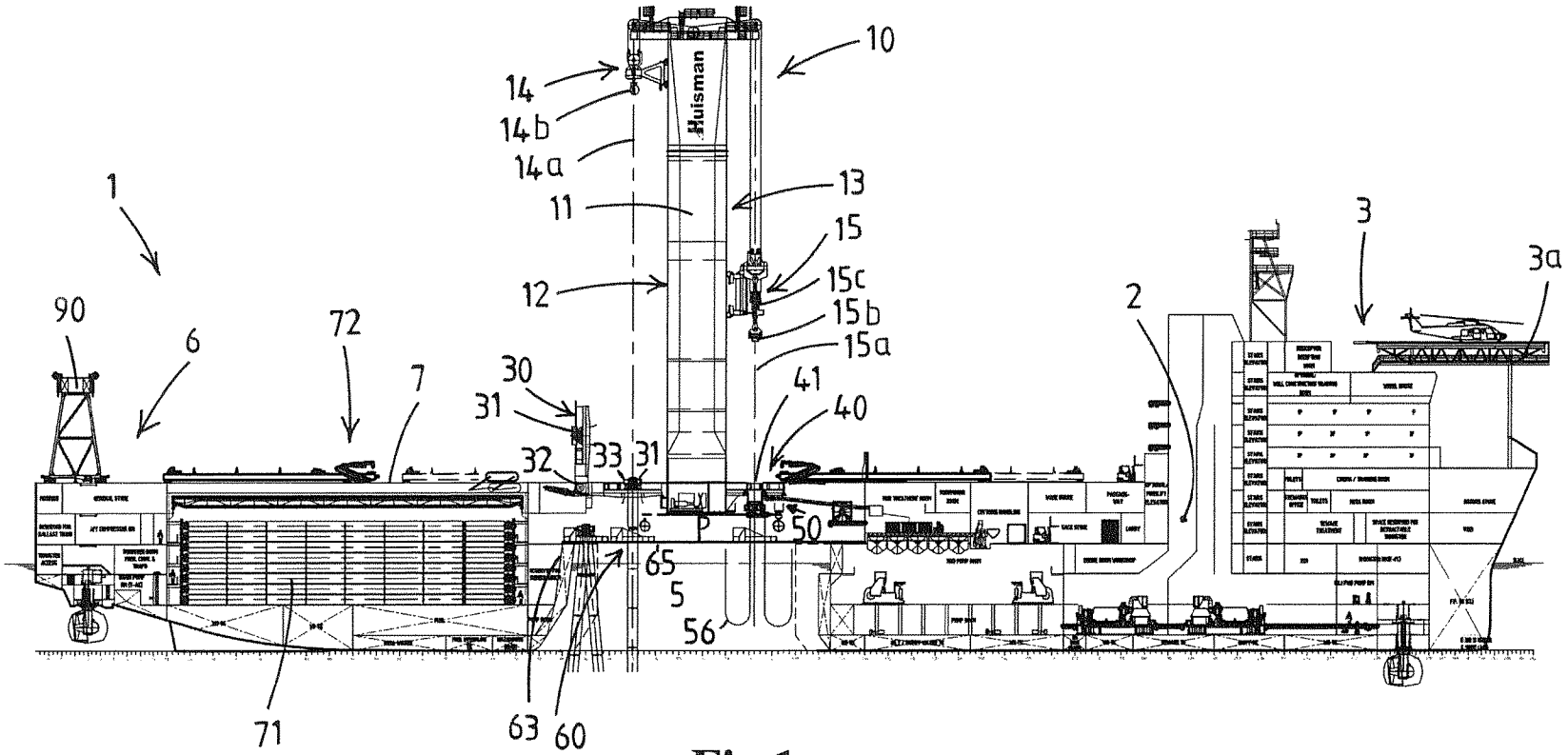

(51) Int. Cl.

| | |
|---|---|
| ***E21B 19/00*** | (2006.01) |
| ***B63B 1/10*** | (2006.01) |
| ***B63B 27/04*** | (2006.01) |
| ***B63B 29/02*** | (2006.01) |
| ***E21B 7/128*** | (2006.01) |
| ***E21B 15/02*** | (2006.01) |
| ***E21B 17/07*** | (2006.01) |
| ***E21B 19/084*** | (2006.01) |
| ***E21B 19/09*** | (2006.01) |
| ***E21B 19/14*** | (2006.01) |
| *B63B 3/14* | (2006.01) |

(52) U.S. Cl.
CPC ..... *B63B 35/4413* (2013.01); *E21B 7/128* (2013.01); *E21B 15/02* (2013.01); *E21B 17/07* (2013.01); *E21B 19/002* (2013.01); *E21B 19/004* (2013.01); *E21B 19/084* (2013.01); *E21B 19/09* (2013.01); *E21B 19/143* (2013.01); *B63B 2003/147* (2013.01)

(58) Field of Classification Search
CPC ..... E21B 19/006; E21B 19/084; E21B 19/09; E21B 19/143; B63B 1/107; B63B 27/04; B63B 29/02; B63B 35/4413
See application file for complete search history.

(56) References Cited

U.S. PATENT DOCUMENTS

| | | | | |
|---|---|---|---|---|
| 6,763,898 | B1 | 7/2004 | Roodenburg et al. | |
| 7,628,225 | B2 * | 12/2009 | Petersson | E21B 15/02 166/341 |
| 8,142,107 | B2 * | 3/2012 | Roodenburg | E21B 15/02 405/158 |
| 8,387,704 | B2 * | 3/2013 | Rodrigues | B63B 35/4413 166/352 |
| 8,925,647 | B2 * | 1/2015 | Humphreys | E21B 15/02 166/358 |
| 9,399,891 | B2 * | 7/2016 | Ahn | E21B 33/064 |
| 2004/0134661 | A1 * | 7/2004 | von der Ohe | E21B 19/006 166/367 |
| 2015/0027717 | A1 * | 1/2015 | Ma | E21B 21/12 166/345 |
| 2016/0024852 | A1 * | 1/2016 | Kannegaard | E21B 15/02 175/5 |

FOREIGN PATENT DOCUMENTS

| | | |
|---|---|---|
| WO | WO 2009/102197 A2 | 8/2009 |
| WO | WO 2012/156303 A2 | 11/2012 |

* cited by examiner

METHOD FOR RISER STRING HANDLING AND AN OFFSHORE DRILLING VESSEL

The present invention relates to a method for riser string handling on an offshore drilling vessel, and an offshore drilling vessel for carrying out such a method.

In WO2009102197 and WO2009102196 of the same applicant offshore drilling vessels are disclosed, comprising:

- a hull having a moonpool extending through the hull; and
- a multiple firing line hoist system mounted on the hull at said moonpool, the multiple firing line hoist system comprising:
  - a tower having a top side and a base connected to the hull of the drilling vessel,
  - a first hoisting device supported by the tower and having a first load attachment device displaceable along a first firing line, which extends essentially parallel to the tower; the first hoisting device being adapted to build and lower a riser string in the first firing line;
  - a second hoisting device supported by the tower and having a second load attachment device displaceable along a second firing line, which extends essentially parallel to the tower; wherein a rotary drilling drive is provided in the second firing line, being adapted to assemble and disassemble a drill string and effect drilling in the second firing line;

It is noted that the first and second firing line are preferably provided at the front and rear side of the tower, wherein it is in general of no interest which of the first and second firing line is at the front side.

In WO2009102197 furthermore a riser tensioner system is disclosed, arranged in the second firing line, adapted to be connected to a top end of the riser string, in order to suspend the riser string from in the second firing line.

The vessel of WO2009102197 is furthermore equipped with a suspended riser transfer device including a support frame, possibly embodied as a skid cart, and a pair of associated rails which extend in longitudinal direction of the moonpool allowing to displace the support frame in a suspended riser transfer path in a longitudinal direction of the moonpool while supporting a riser string of interconnected riser. The support frame with the suspended riser string can be moved to the second firing line, where the riser string can be attached to a riser tensioner system arranged on board of the vessel.

When displacing a riser string in longitudinal direction of the moonpool in a suspended riser transfer path, large stresses are induced to the riser string. As this is a relatively rigid and delicate pipe string, it is important to provide an arrangement allowing for angular motion of the riser string with respect to the riser hang-off assembly, in order to avoid undesirable stresses.

According to WO2009102197, when a riser string is transferred by the support frame, the top end of the riser string is provided with a flexible element providing a gimballing effect, to allow angular motion of the riser string with respect to the support frame in order to avoid undesirable stresses. As the flexible element is provided on the riser string, the flexible element can also be used when the riser string is not suspended from the support frame but e.g. from deck.

Prior to connecting the top end of the riser string to the riser tensioner system, in order to suspend the riser string from in the second firing line, the special element needs to be removed from the top end of the riser string. Hence, after displacement of the riser string, the special element is to be removed in the second firing line.

For the removal of the special element in the second firing line the second hoisting device is used. In order to assemble and prepare the riser tensioner system in the second firing line, the second hoisting device is also required. Because the second hoisting device is thus required to remove the special flexible element, it is not possible to assemble and prepare the riser tensioner system in the second firing line prior to the arrival of the riser string provided with a special element at the top end.

The present invention aims to propose an improved method for riser string handling on such an offshore drilling vessel, and an improved offshore drilling vessel for carrying out such a method.

In order to carry out the method according to the present invention, the suspended riser transfer device is provided with a riser hang-off assembly and a gimbal device, to which the riser hang-off assembly is mounted. The riser hang-off assembly is actuable between an open configuration in which the riser hang-off assembly is adapted to move around an upper end of a riser string, and a closed configuration in which the riser hang-off assembly engages and supports the riser string, leaving the top end of the riser string exposed to allow for connection to the riser tensioner system. The method according to the invention comprises the following steps:

a) building and lowering a riser string in the first firing line,
b) suspending the riser string from the first load attachment device,
c) positioning the riser hang-off assembly in the open configuration in the first firing line;
d) positioning an upper end of the riser string in the riser hang-off assembly and actuating the riser hang-off assembly to the closed configuration,
e) transferring the weight from the riser string from the first load attachment device to the riser hang-off assembly,
f) disconnecting the first load attachment device from the riser string,
g) displacing the riser hang-off assembly in the suspended riser transfer path while it supports the riser string in a gimballing manner from the first firing line to the second firing line,
h) connecting the top end of the riser string to the riser tensioner system,
i) transferring the weight from the riser string from the riser hang-off assembly to the riser tensioner system,
j) actuating the riser hang-off assembly to the open configuration and thus disconnecting the riser hang-off assembly from the riser string,
k) displacing the riser hang-off assembly in the suspended riser transfer path from the second firing line to the first firing line.

The invention also relates to an offshore drilling vessel for carrying out such a method.

According to the invention, not the riser string itself but the suspended riser transfer device is provided with a gimbal device, in order to avoid undesirable stresses. In particular, the suspended riser transfer device is provided with a riser hang-off assembly and a gimbal device, to which the riser hang-off assembly is mounted. As a result, similar to the known method, the frame of the suspended riser transfer device is displaceable in longitudinal direction of the moonpool while the riser string is supported in a gimballing manner according to step g). The riser hang-off assembly of the invention engages and supports the riser string in a closed configuration, in which the riser hang-off assembly leaves the top end of the riser string exposed to allow for connection to the riser tensioner system. Hence, there are no additional components added to the top end of the riser string, that need to be removed in the second firing line.

The arrangement of the invention thus differs from the arrangement of WO2009102197 in that according to the invention the riser transfer device comprises a gimbal device and a riser hang-off assembly engaging an upper end the riser string, whereas in WO2009102197 the top end of the riser string comprises a flexible element and the riser transfer device engages this flexible element.

According to the invention, it is thus advantageous that no additional operations on the riser string are required in the second firing line after arrival of the riser string in the second firing line. As a result, simultaneous building and lowering a riser string in the first firing line, and assembling and preparing a riser tensioner system in the second firing line is allowed, according to step a). In addition, method step h), i.e. connecting the top end of the riser string to the riser tensioner system, can be performed immediately after arrival of the riser hang-off assembly, without any intermediate step of removing a special flexible element. As a result, the efficiency of building up a riser string is improved, possibly by 1-2 working days.

The riser hang-off assembly of the invention is actuable between an open configuration in which the riser hang-off assembly is adapted to move around an upper end of a riser string and a closed configuration in which the riser hang-off assembly engages and supports the riser string. The open configuration allows the riser hang-off assembly, supported on the frame, to sideways skid towards and away from a riser string, thereby enabling the suspended riser transfer device to perform the method of claim 1, in particular the steps of:

c) positioning the riser hang-off assembly in the open configuration in the first firing line; and j) actuating the riser hang-off assembly to the open configuration and thus disconnecting the riser hang-off assembly from the riser string, k) displacing the riser hang-off assembly in a suspended riser transfer path in longitudinal direction of the moonpool from the second firing line to the first firing line.

In the closed configuration the riser hang-off assembly engages and supports the riser string. To this end, the riser hang-off assembly of the suspended riser transfer device may include a clamping device or similar, e.g. a device known as a riser spider. Advantageously, the riser hang-off assembly comprises multiple locking mechanisms such as rams, that engage and support, in particular secure the riser string to the riser hang-off assembly. The locking mechanisms are preferably hydraulically operated, but otherwise mechanically operated mechanisms are also conceivable. Optionally, the locking mechanisms are remotely operated. In a possible embodiment, four or six hydraulic rams are provided. Optionally, lock state indicators are provided, identifying the locking mechanism as locked or not locked. In particular, sensors may be provided that identify whether or not a tubular is engaged by the riser hang-off assembly. Additional back-up or secondary locking mechanisms may also be included. It is possible to equip a locking mechanism, e.g. a ram, with a safe "lock-out", making disengagement of the hang-off assembly impossible when carrying a riser string.

The gimbal device of the suspended riser transfer device allows for the angular motion of the riser string with respect to the riser hang-off assembly, to avoid undesirable stresses. The gimbal device is e.g. configured comprising multiple elastomeric dampeners that absorb the loads induced by the various motions of the drilling vessel. Alternative configurations are also conceivable.

The suspended riser transfer device of the invention comprises a frame supporting both the riser hang-off assembly and the gimbal device. As indicated above, some method steps of the invention are enabled by the riser hang-off assembly of the invention being actuable between an open configuration in which the riser hang-off assembly is adapted to move around an upper end of a riser string and a closed configuration in which the riser hang-off assembly engages and supports the riser string. The frame and gimbal device should allow the riser hang-off assembly to move around an upper end of a riser string in an open configuration thereof and engage and supports the riser string in a closed configuration thereof.

Preferably, the gimbal device is also actuable between an open configuration and a closed configuration, together with the riser hang-off assembly that is mounted to the gimbal device. Alternatively, the gimbal device is configured partially open, i.e. in a C-shape when seen from above, with the opening of the C in the direction of the second firing line, allowing the gimbal device to move away from the second firing line in the direction of the first firing line.

The frame is preferably configured partially open, i.e. in a C-shape when seen from above, with the opening of the C in the direction of the second firing line, allowing the frame to move away from the second firing line in the direction of the first firing line. In a less preferred embodiment, the frame is also configured actuable between an open configuration and a closed configuration, together with the riser hang-off assembly.

The frame supporting the riser hang-off assembly and the gimbal device is possibly embodied as a skid cart, skiddable along the rails, preferably a pair of associated rails, of the suspended riser transfer device which extend in longitudinal direction along the moonpool, at least between the first firing line and the second firing line.

Advantageously, the suspended riser transfer device is also suitable to engage and support other tubulars, such as casings, drill pipes, landing joints and the like. Optionally, the riser hang-off assembly supported by the frame may be replaced by an alternative hang-off assembly, optionally with a gimbal device.

In a possible embodiment, the riser tensioner system comprises:

- a riser tensioner ring,
- riser tensioners connected to the vessel and supporting the riser tensioner ring in the second firing line,
- a telescopic joint comprising an inner barrel and an outer barrel with a seal therebetween, wherein the riser tensioner ring is adapted to be connected to the top of the outer barrel.

In such an embodiment, the method of the invention, in particular assembling and preparing a riser tensioner system in the second firing line, advantageously comprises the following steps:

i. positioning the riser tensioner ring in the second firing line above the suspended riser transfer path, ii. positioning the telescopic joint in the second firing line, iii. connecting the second load attachment device to the telescopic joint and providing the telescopic joint at a level above the suspended riser transfer device, allowing the telescopic joint to be connected to the exposed top end of the riser string, iv. displacing the riser hang-off assembly in a suspended riser transfer path in longitudinal direction of the moonpool while it supports the riser string in a gimballing manner from the first firing line to the second firing line, v. lowering the telescopic joint by the second hoisting device and connecting the top end of riser string to the lower end of the outer barrel of the telescopic joint, vi. transferring the weight from the riser string from the riser hang-off assembly to the telescopic joint, e.g. by lifting the telescopic joint by the second hoisting device, vii. actuating the riser hang-off assembly to the open configuration and thus disconnecting the riser hang-off assembly from the riser string, viii. displacing the riser hang-off assembly in the suspended riser transfer path from the second firing line to the first firing line, ix. further lowering the telescopic joint by the second hoisting device and connecting the riser tensioner ring to the top of the outer barrel of the telescopic joint, x. further lowering the telescopic joint by the second hoisting device until the weight of the telescopic joint and suspended riser is supported by the riser tensioners, xi. disconnecting the second load attachment device and from the telescopic joint.

In a possible embodiment, the riser tensioner system further comprises a landing joint, and a clamp for the telescopic joint, e.g. a rotary table, which is provided above the riser tensioner ring in the second firing line. In such an embodiment, the method of the invention, in particular assembling and preparing a riser tensioner system in the second firing line, advantageously comprises the following steps:

i. positioning the riser tensioner ring in the second firing line above the suspended riser transfer path, ii. positioning the telescopic joint in the clamp in the second firing line, iii. connecting the landing joint to the second load attachment device and the telescopic joint, iv. lifting the telescopic joint with the landing joint by the second hoisting device to a level above the suspended riser transfer device, allowing the telescopic joint to be connected to the exposed top end of the riser string, v. displacing the riser hang-off assembly in a suspended riser transfer path in a longitudinal direction of the moonpool while it supports the riser string in a gimballing manner from the first firing line to the second firing line, vi. lowering the telescopic joint with the landing joint by the second hoisting device and connecting the top end of riser string to the lower end of the outer barrel of the telescopic joint, vii. transferring the weight from the riser string from the riser hang-off assembly to the telescopic joint, e.g. by lifting the telescopic joint by the second hoisting device, viii. actuating the riser hang-off assembly to the open configuration and thus disconnecting the riser hang-off assembly from the riser string, ix. displacing the riser hang-off assembly from the second firing line to the first firing line in a suspended riser transfer path, x. further lowering the telescopic joint with the landing joint by the second hoisting device and connecting the riser tensioner ring to the top of the outer barrel of the telescopic joint, xi. further lowering the telescopic joint with the landing joint by the second hoisting device until the weight of the telescopic joint and suspended riser is supported by the riser tensioners, xii. disconnecting the landing joint from the second load attachment device and from the telescopic joint.

In a possible embodiment, the riser tensioner system further comprises a top flex joint above the inner barrel of the telescopic joint, to provide lateral restraint and reduce rotation through elastomeric stiffness elements. Optionally, also a diverter is located just above the upper flex joint and just below the drill floor allowing mud with drill cuttings returning from the well through the riser to be dumped to a mud processing system. In such an embodiment, the method of the invention, is advantageously completed by connecting the top flex joint and the diverter to the top end of the inner barrel.

The riser tensioners of the riser tensioner system provide and maintain top tension on the deployed riser string. Advantageously, the riser tensioner system includes a set of sheaves at each lateral side of the moonpool, and a set of hydraulic tensioner cylinders in the hull section at the lateral sides of the moonpool. Cables of the riser tensioner system are fastened to the riser tensioner ring.

The telescopic joint, as is known in the art, comprises an inner barrel and an outer barrel with a seal therebetween. For example, a dual packer is disposed at the upper end of the outer barrel. The inner and outer barrels of the telescopic joint move relative to each other to allow vertical motion of the vessel while holding the riser string with near constant tension by compensating for the required change in the length of the riser string as the vessel experiences surge, sway and heave.

The riser string handling method of the invention is to be performed on an offshore drilling vessel comprising a hull with a moonpool as described in claim 1. In an embodiment, the vessel is a monohull vessel. For example the monohull vessel comprises a bow and a stern, and an accommodation topside having crew quarters and a bridge arranged on the hull at the bow. A main deck extends between the accommodation topside and the stern of the vessel. Advantageously, a front main deck portion of the main deck extends forward of the moonpool and a rear main deck portion of the main deck extends rearward of the moonpool; and wherein the base of the tower is integral with the hull and extends between sections of the hull on port and starboard side of the moonpool, the base being spaced from the bow side and from the stern side of the moonpool, thereby forming a front moonpool area forward of the tower and a rear moonpool area rearward of the tower, wherein the tower has a rear side where the first firing line extends and an opposed front side where the second firing line extends, as well as opposed lateral sides. In an alternative embodiment, the vessel has another type of hull, e.g. a semi-submersible having a deck box structure support by legs on parallel pontoons.

The offshore drilling vessel of the invention comprises a multiple firing line hoist system comprising a tower. The tower may e.g. be embodied as a mast of a hollow construction, as has been realized previously by the applicant, e.g. on the Noble Globetrotter vessel, and has been described in previous applications, such as WO2009102197 and WO2009102196 as indicated above, and prior to that in U.S. Pat. No. 6,763,898 and WO2002018742. Yet alternatively, the tower may be embodied as a derrick or RamRig or the like.

In a possible embodiment, the multiple firing line hoist system comprises:

a mast having a top side and a base connected to the hull of the drilling vessel, wherein the mast has a hollow construction with a first side and an opposed second side, a first hoisting device supported by the mast and having a first load attachment device displaceable along a first firing line, which extends essentially parallel to the mast, on the outside of and adjacent to the first side of the mast; the first hoisting device being adapted to build and lower a riser string in the first firing line;

a second hoisting device supported by the mast and having a second load attachment device displaceable along a second firing line, which extends essentially parallel to the mast, on the outside of and adjacent to the second side of the mast; wherein a rotary drilling drive, e.g. a top drive, is provided in the second firing line, being adapted to assemble and disassemble a drill string and effect drilling in the second firing line.

Possibly, the first and second hoisting devices each include one or more cables and one or more associated winches to manipulate the position of each of the first and second load attachment devices relative to the mast.

In the first firing line, the vessel is preferably provided with a first working deck to assist in building and lowering of a riser string of interconnected risers in the first firing line. The first working deck covers a portion of the moonpool at said a side of the tower while the first firing line extends through said first working deck. Preferably the first working deck includes an opening therein that can be aligned with the first firing line, so that objects, e.g. a string of tubulars, e.g. a riser string, can be lowered through the deck into the sea. The first working deck preferably includes a suspension device arranged at the opening in the deck, said suspension device being adapted to connect to and support the top end of a string of tubulars, most preferably a riser string with a BOP attached to the lower end of the riser string. This suspension device may include a clamping device or similar to suspend a string of tubulars from the deck, e.g. a device known as a riser spider. It will be appreciated that in this preferred embodiment the first working deck, is supporting the weight of the suspended string of tubulars. In a practical embodiment said weight will be at least 200 tonnes, so the first working deck has a structure allowing to support a string of tubulars, e.g. risers, having a weight of at least 200 tonnes, possibly with an additional BOP attached to the lower end of the string.

In this embodiment, the suspended riser transfer device is provided below the first working deck, allowing the riser hang-off assembly to be displaced below the first working deck.

In an embodiment, the first hoisting device is adapted for raising and lowering a riser string with a BOP (Blow Out Preventer) attached to the lower end thereof, which is usually extremely heavy, to the seabed in the first firing line. In this embodiment, the riser hang-off assembly should be able to support the riser string with the BOP attached thereto.

Preferably, the offshore drilling vessel is provided with a BOP storage, preferably in the hull of the vessel adjacent the moonpool. Advantageously, the first working deck is a mobile working deck, e.g. as disclosed in WO2009/102197, which in an active position covers a portion of the moonpool at a side of the tower, as described above, and in a non-active position allows the BOP to be brought in said first firing line and manipulated by the first hoisting device.

In an embodiment, a first parking position for the frame is provided in the vicinity of the first firing line, in a direction opposed to the second firing line. In this embodiment, the rails of the suspended riser transfer device extend beyond the first firing line to the first parking position. In such an embodiment, the frame with the riser hang-off assembly is in the first parking position, while building and lowering a riser string in the first firing line, and simultaneously assembling and preparing a riser tensioner system in the second firing line, and also during suspending the riser string from the first load attachment device. In step c), the frame with the riser hang-off assembly is displaced in the suspended riser transfer path from the first parking position to the first firing line. Furthermore, in step g) of the method of the invention, the frame with the riser hang-off assembly is allowed to move back to the first parking position.

In an embodiment, a second parking position for the frame is provided in the vicinity of the second firing line, in a direction opposed to the first firing line, and the rails of the suspended riser transfer device extend beyond the second firing line to the second parking position.

It is advantageous to provide one or more parking positions for a frame supporting the riser hang-off assembly and gimbal device, while the riser hang-off assembly engages and supports the riser string. As a result, either one of the firing lines can be used, without a suspended riser string occupying one of the firing lines, while at the same time the suspended riser string remains being assembled and lowered.

For example, after building and lowering the riser string, it may become necessary to detach the riser string from the diverter and any other sensitive equipment. For example, the offshore drilling vessel may need to be moved from one location to another and movement of the offshore drilling vessel relative to the riser string would damage the equipment. In such cases, instead of pulling up and dismantling the entire riser string, the riser string may be supported by the riser hang-off assembly at a parking position, after it is detached from the diverter and other equipment. The riser string may be directly supported by the hang-off assembly. Alternatively, it is conceivable that the telescopic joint remains connected to the riser string, and that the outer barrel thereof is supported by the riser hang-off assembly.

According to another example, one may use the second firing line for lowering a top hole drill string, while the riser string is parked at a parking position.

According to yet another example, a riser string is lowered, optionally including a BOP in the second firing line, according to the method of claim 1. In step ix) the riser hang-off assembly is displaced from the second firing line to the first firing line. In an embodiment including a first parking position for the frame of the suspended riser transfer device of the offshore drilling vessel, provided in the vicinity of the first firing line, in a direction opposed to the second firing line, the riser hang-off assembly is displaced from the second firing line to the first parking position. With the suspended riser string in the second firing line and the riser hang-off assembly in the parking position, the first firing line is available for lowering other equipment, such as an X-mas tree. Optionally, the hang-off assembly can assist in the assembly and lowering process of the other equipment. The X-mas tree may be lowered by a drill string, which is in this situation also referred to as a landing joint. In such cases, the riser hang-off assembly is preferably adapted to move around an upper end of a drill string. Alternatively, the riser hang-off assembly of the suspended riser transfer device may be removed from the frame, and replaced by a dedicated drill string hang off assembly.

Advantageously, in an embodiment of an offshore comprising a first and second parking position, the suspended riser transfer device further comprises:

a second riser hang-off assembly being actuable between an open configuration in which the riser hang-off assembly is adapted to move around an upper end of a riser string, and a closed configuration in which the riser hang-off assembly engages and supports the riser string, leaving the top end of the riser string exposed to allow for connection to the riser tensioner system;

a second gimbal device, to which the second riser hang-off assembly is mounted;

a second frame supporting both the second riser hang-off assembly and the second gimbal device.

Hence, on the rails of the suspended riser transfer device, both a first and a second frame are displaceable in the suspended riser transfer path, each frame supporting a riser hang-off assembly and a gimbal device. Hence, both frames are adapted to engage and support the riser string.

In such an embodiment, the method of the invention may be succeeded by the following steps:

positioning the second riser hang-off assembly in the open configuration in the second firing line, positioning an upper end of the riser string in the second riser hang-off assembly and actuating the second riser hang-off assembly to the closed configuration, transferring the weight from the riser string from the riser tensioner to the second riser hang-off assembly, disconnecting the riser tensioner from the riser string, displacing the second riser hang-off assembly in the suspended riser transfer path while it supports the riser string in a gimballing manner from the second firing line to the second parking position.

The riser string may be directly supported by the hang-off assembly. Alternatively, it is conceivable that the telescopic joint remains connected to the riser string, and that the outer barrel thereof is supported by the riser hang-off assembly. The advantage of two displaceable frames is that while the riser string is supported by the second frame, the first frame can be used for other purposes, such as BOP maintenance or other procedures as indicated in the description.

The present invention also relates to an offshore drilling vessel comprising:

a hull having a moonpool extending through the hull; and a multiple firing line hoist system mounted on the hull at said moonpool, the multiple firing line hoist system comprising:

a tower having a top side and a base connected to the hull of the drilling vessel, a first hoisting device supported by the tower and having a first load attachment device displaceable along a first firing line, which extends essentially parallel to the tower; the first hoisting device being adapted to build and lower a riser string in the first firing line;

a second hoisting device supported by the tower and having a second load attachment device displaceable along a second firing line, which extends essentially parallel to the tower; wherein a rotary drilling drive is provided in the second firing line being adapted to assemble and disassemble a drill string and effect drilling in the second firing line;

a riser tensioner system arranged in the second firing line, adapted to be connected to a top end of the riser string, in order to suspend the riser string from in the second firing line;

a suspended riser transfer device, comprising:

a first riser hang-off assembly being actuable between an open configuration in which the riser hang-off assembly is adapted to move around an upper end of a riser string, and a closed configuration in which the first riser hang-off assembly engages and supports the riser string, leaving the top end of the riser string exposed to allow for connection to the riser tensioner system;

a first gimbal device, to which the first riser hang-off assembly is mounted;

a first frame supporting both the first riser hang-off assembly and the first gimbal device;

a second riser hang-off assembly being actuable between an open configuration in which the riser hang-off assembly is adapted to move around an upper end of a riser string, and a closed configuration in which the riser hang-off assembly engages and supports the riser string, leaving the top end of the riser string exposed to allow for connection to the riser tensioner system;

a second gimbal device, to which the second riser hang-off assembly is mounted;

a second frame supporting both the second riser hang-off assembly and the second gimbal device;

wherein a first parking position for the frame is provided in the vicinity of the first firing line, in a direction opposed to the second firing line, wherein a second parking position for the frame is provided in the vicinity of the second firing line, in a direction opposed to the first firing line, rails extending in longitudinal direction along the moonpool from the first parking position beyond the first firing line, via the first firing line and the second firing line, to the second parking position beyond the second firing line, the rails allowing to displace the frame in a suspended riser transfer path in longitudinal direction of the moonpool while the riser string is supported in a gimballing manner.

Optionally, the tower is embodied as a mast having a hollow construction with a first side and an opposed second side, wherein the first firing line extends on the outside of and adjacent the first side of the tower and the second firing line extends on the outside of and adjacent second side of the mast. In an embodiment, the first and second hoisting devices each include one or more cables and one or more associated winches to manipulate the position of each of the first and second load attachment devices relative to the mast.

Advantageously, the suspended riser transfer device is also suitable to engage and support other tubulars, such as casings, drill pipes, landing joints and the like. Optionally, the riser hang-off assembly supported by the frame may be replaced by an alternative hang-off assembly, optionally with a gimbal device.

The invention further relates to an offshore drilling vessel comprising a hull having a moonpool extending through the hull and a tower connected to the hull of the drilling vessel, wherein a hoisting device is supported by the tower and having a load attachment device that is displaceable along a firing line, which extends essentially parallel to the tower, further comprising a transfer system, comprising:

a riser hang-off assembly adapted to move around an upper end of a riser string, optionally mounted to a gimbal device;

a drill string hang-off assembly adapted to move around an upper end of a drill string, e.g. a landing joint;

a frame adapted to support the riser hang-off assembly and the drill string hang-off assembly, allowing both hang-off assemblies to be exchanged;

rails extending in longitudinal direction along the moonpool, allowing to displace the frame in a transfer path in a longitudinal direction of the moonpool while supporting a riser string or a drill string.

Optionally, the transfer system is provided with yet an alternative hang-off assembly, in addition to or instead of the riser hang-off assembly or the drill string hang-off assembly.

Figure 2:
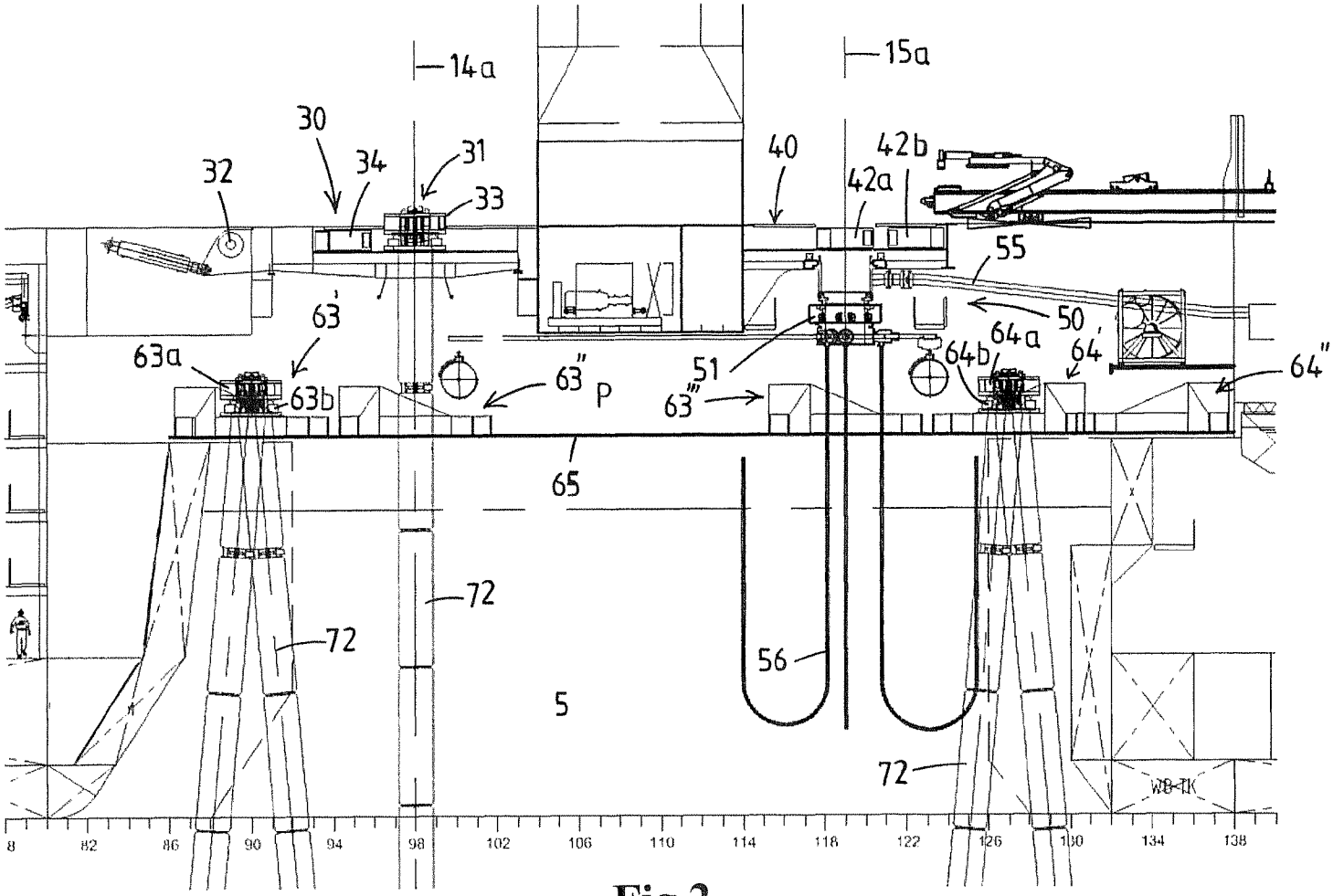
Figure 3A:
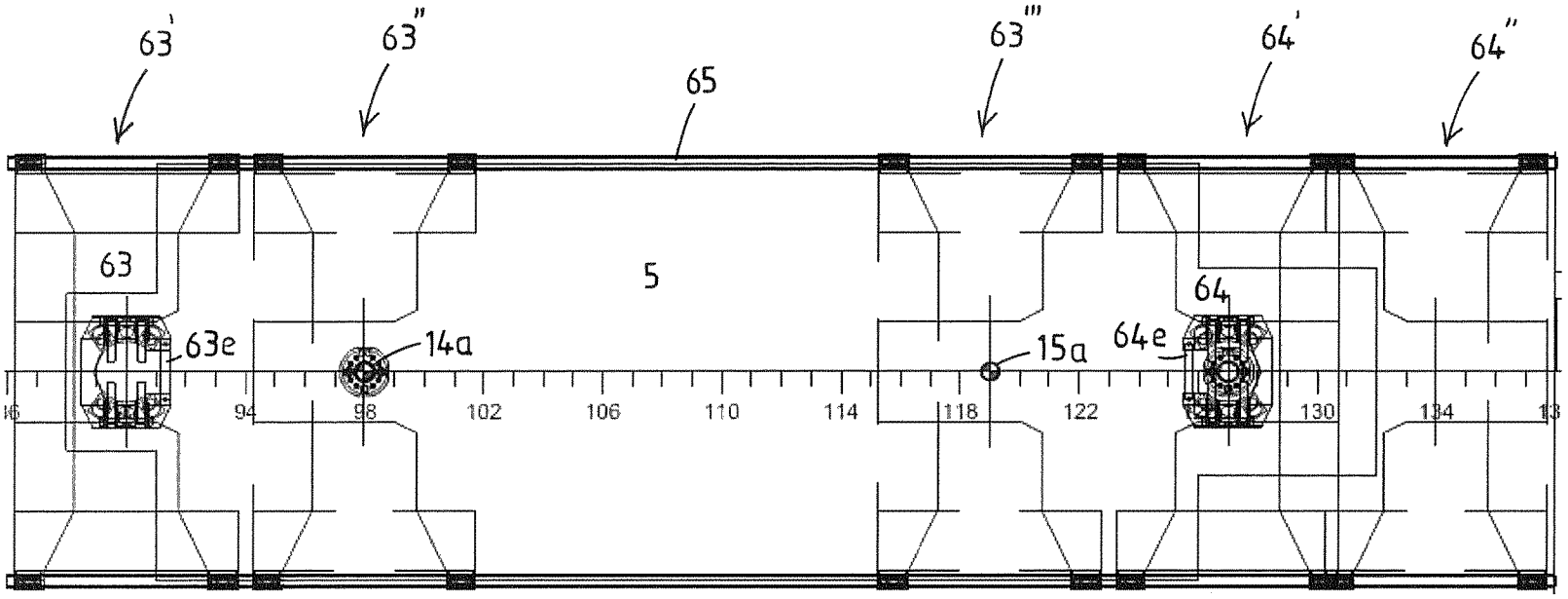
Figure 3B:
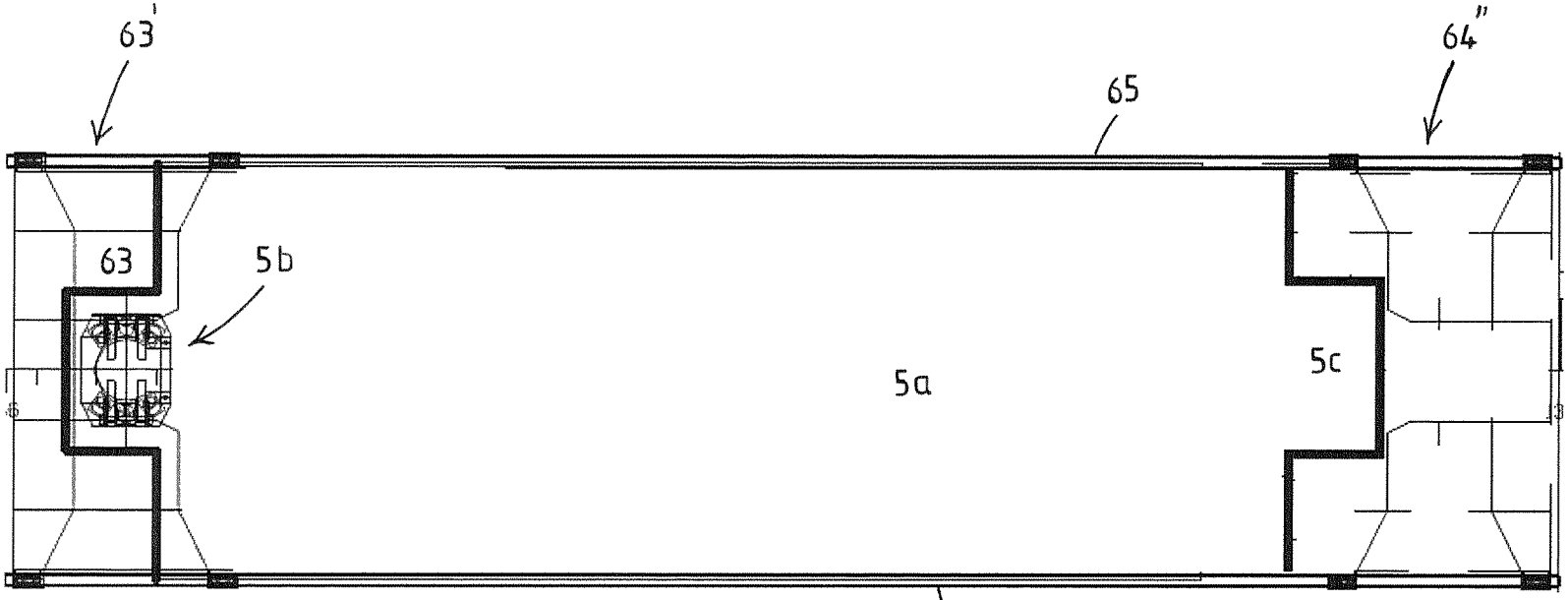
Figure 4A:
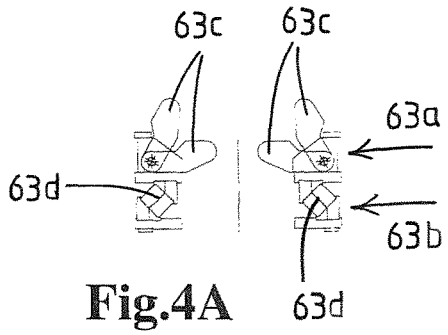
Figure 4B:
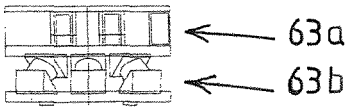
Figure 4C:
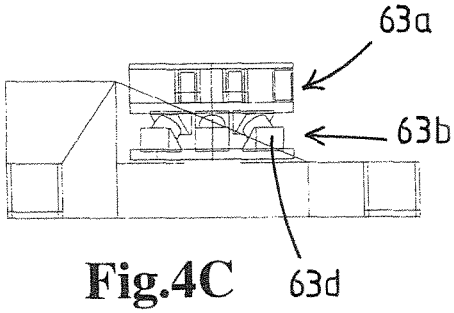
Figure 4D:
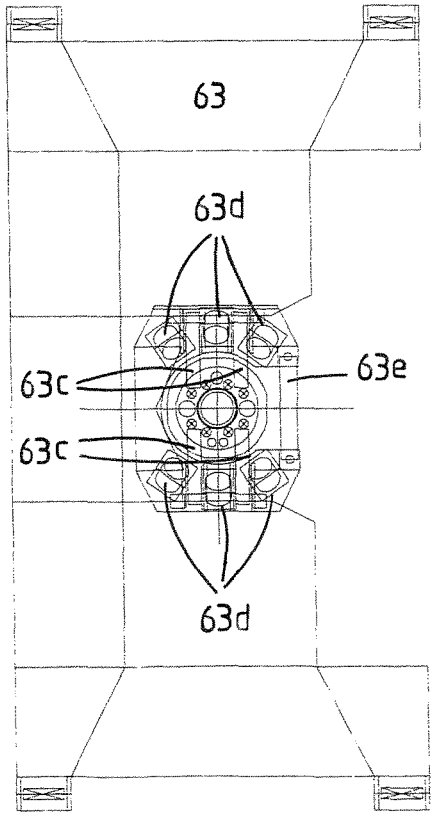
Figure 5A:
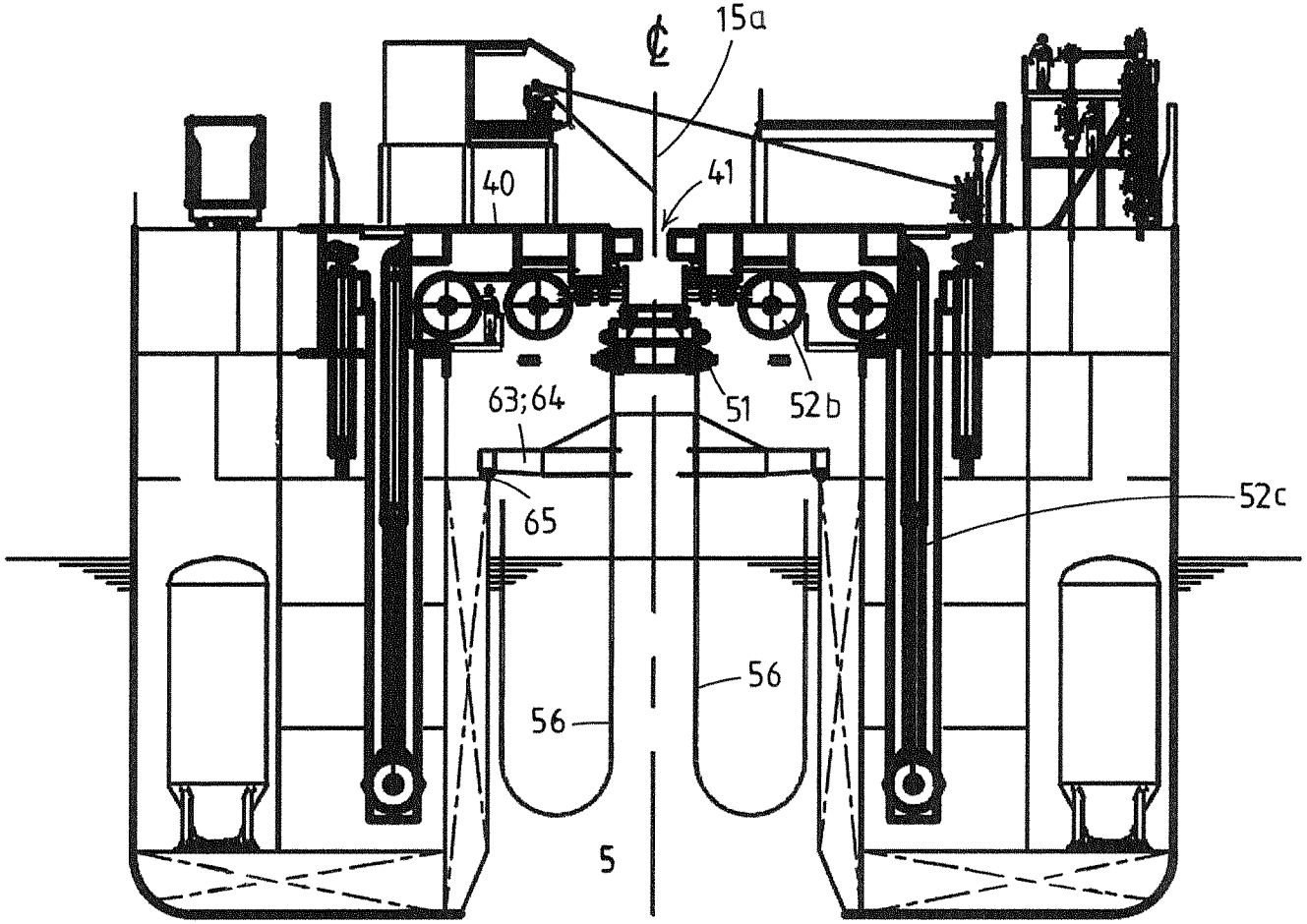
Figure 5B:
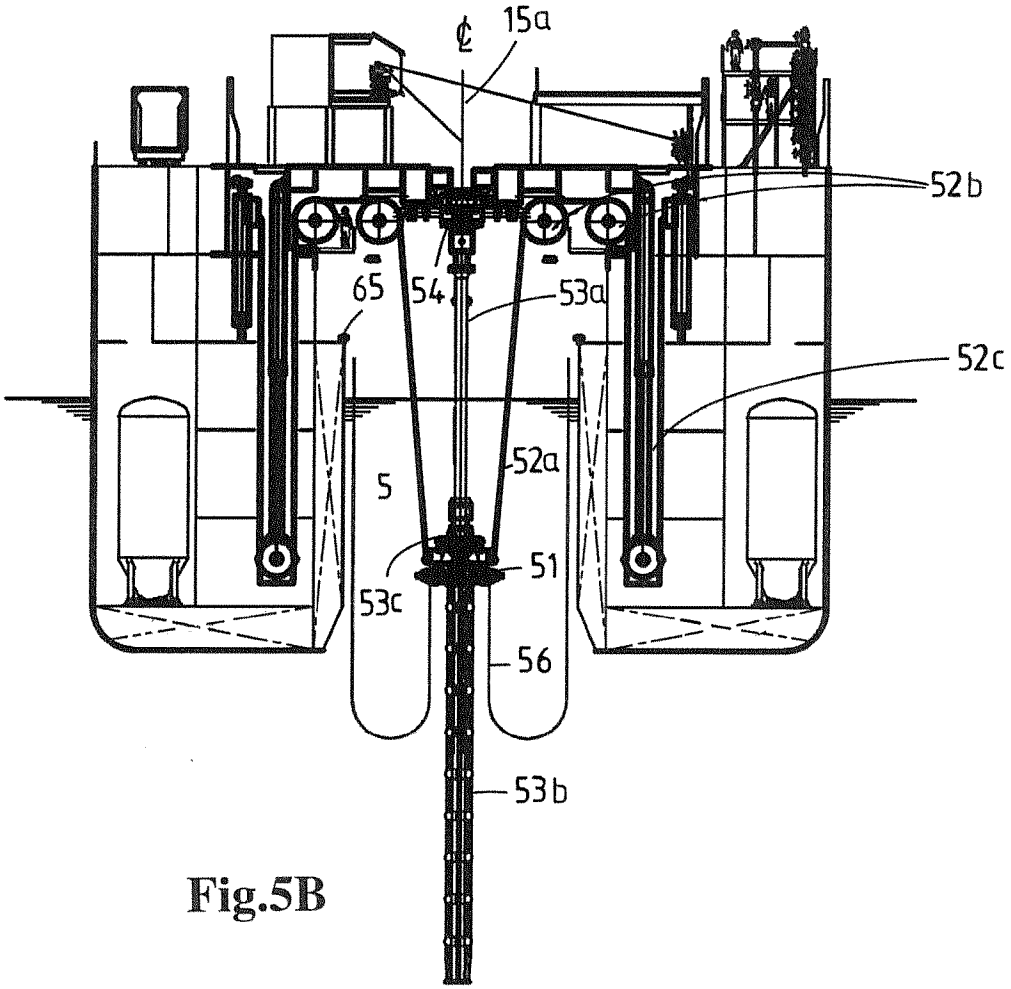
Figure 6:
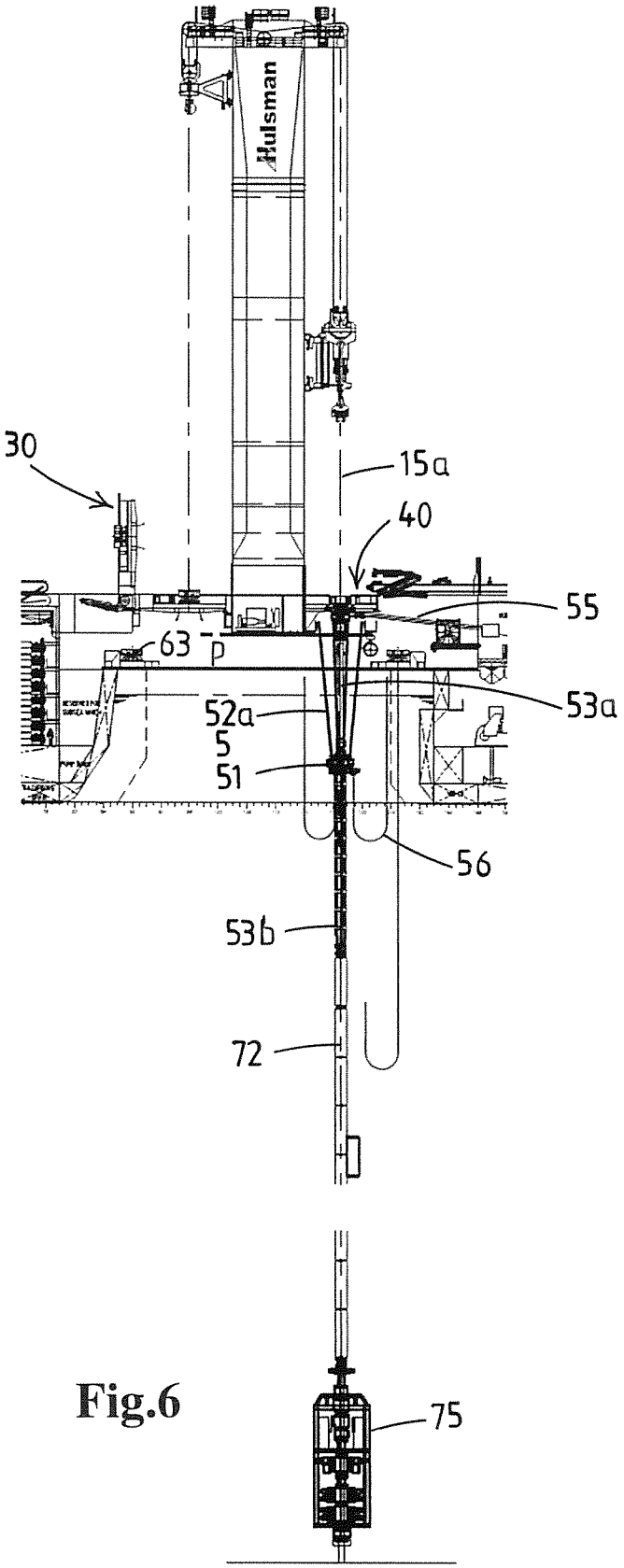
Figure 7A:
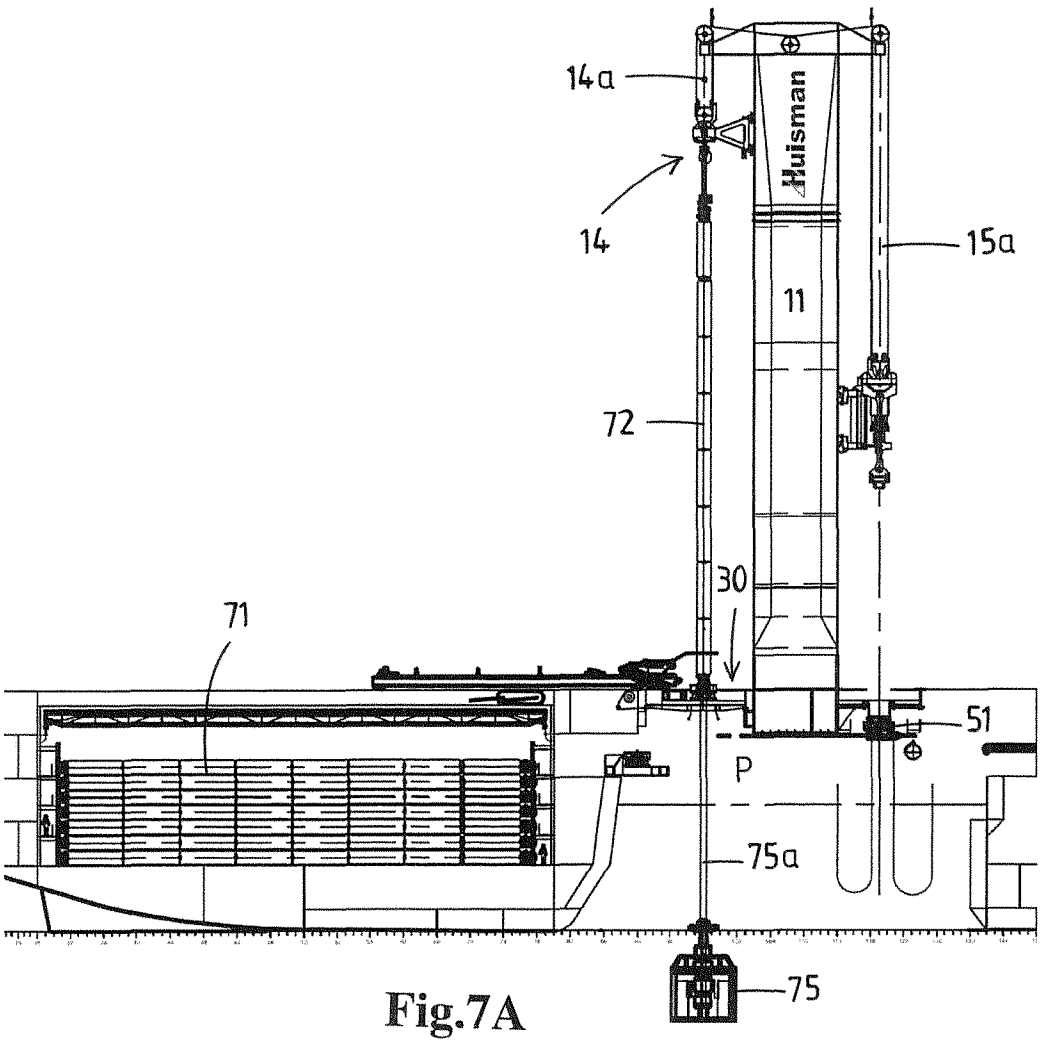
Figure 7B:
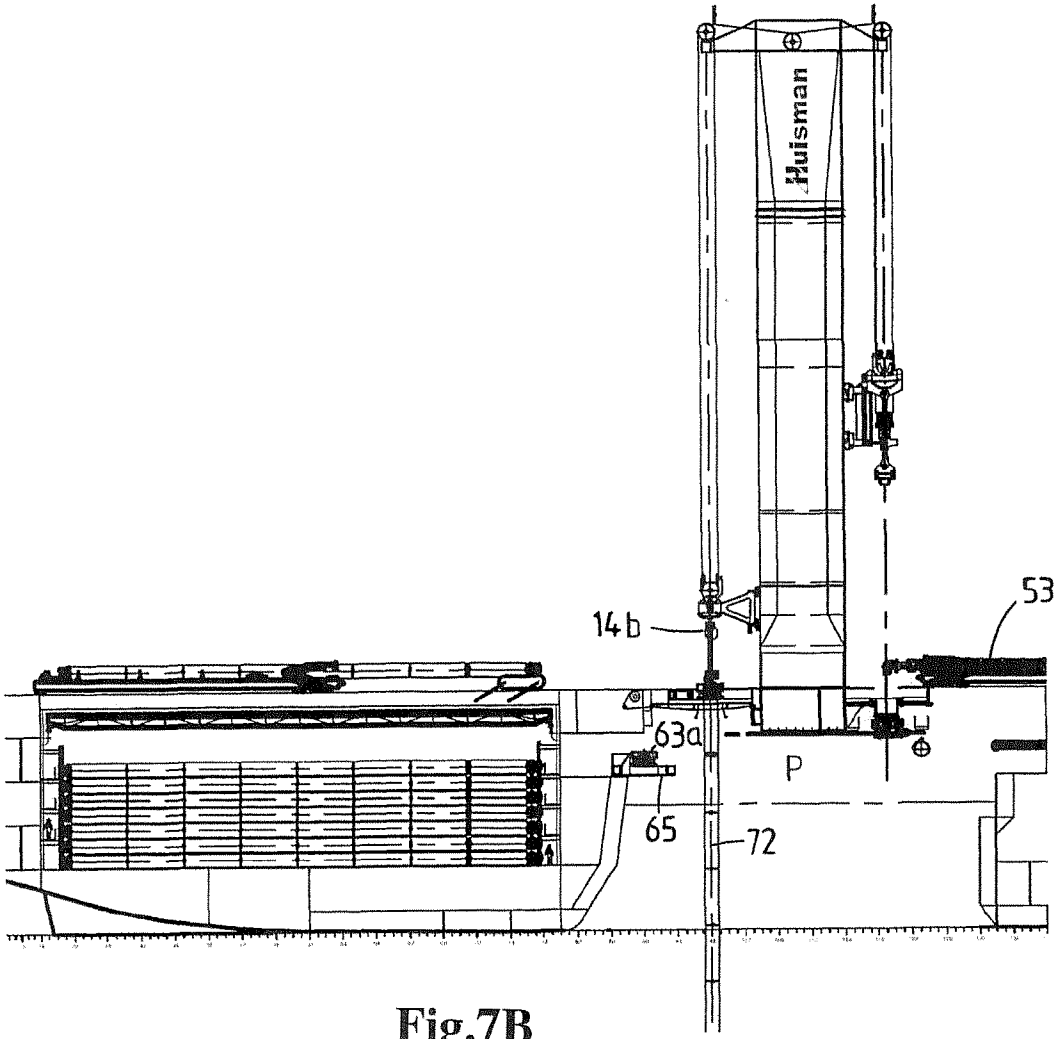
Figure 7C:
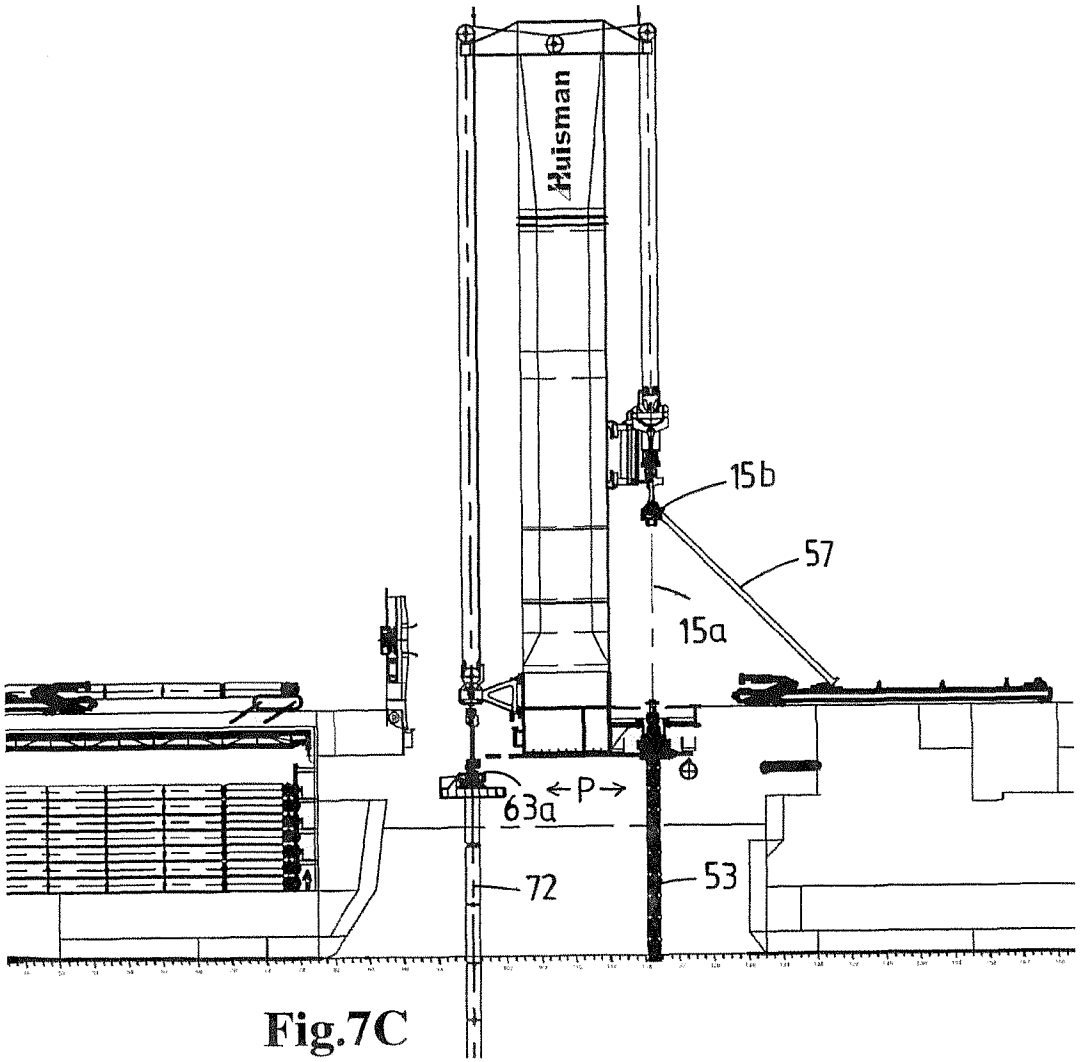
Figure 7D:
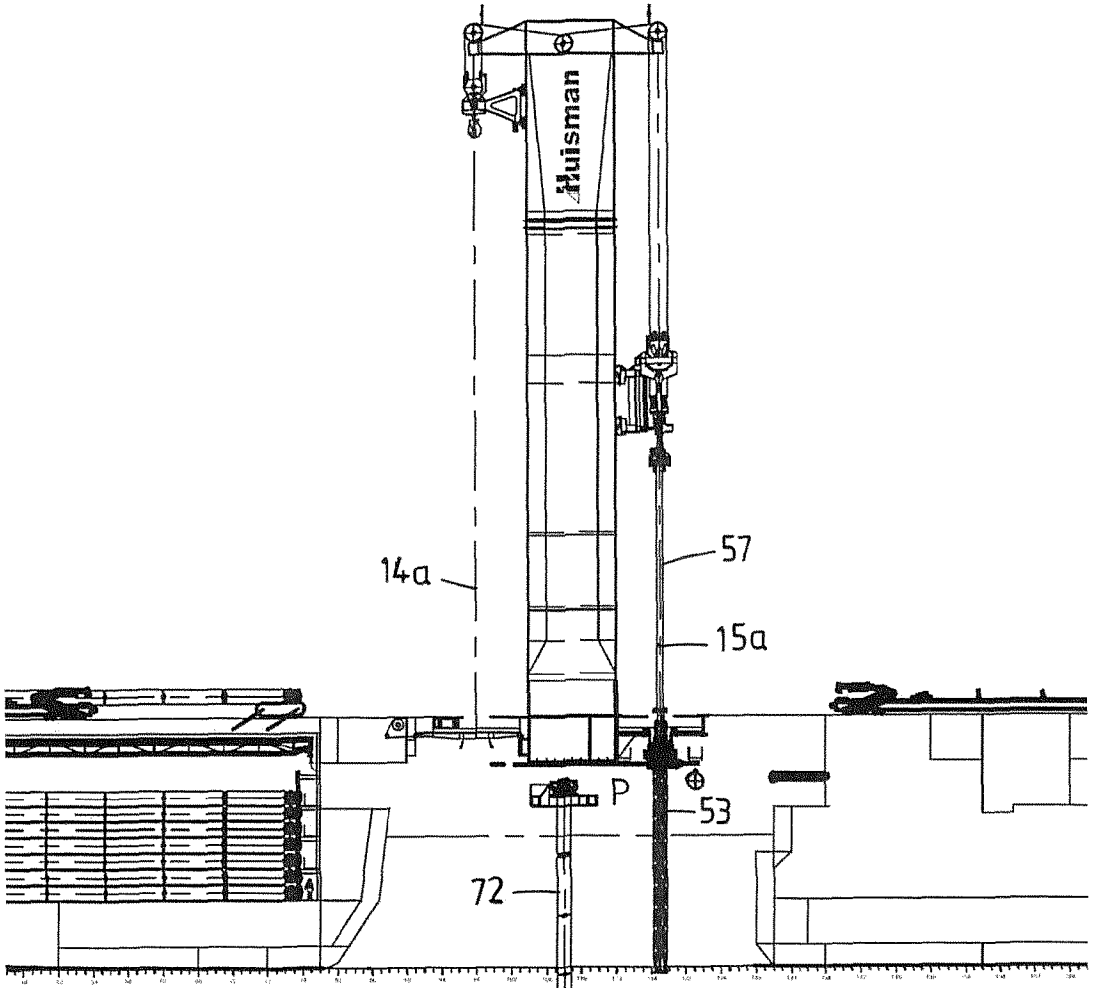
Figure 7E:
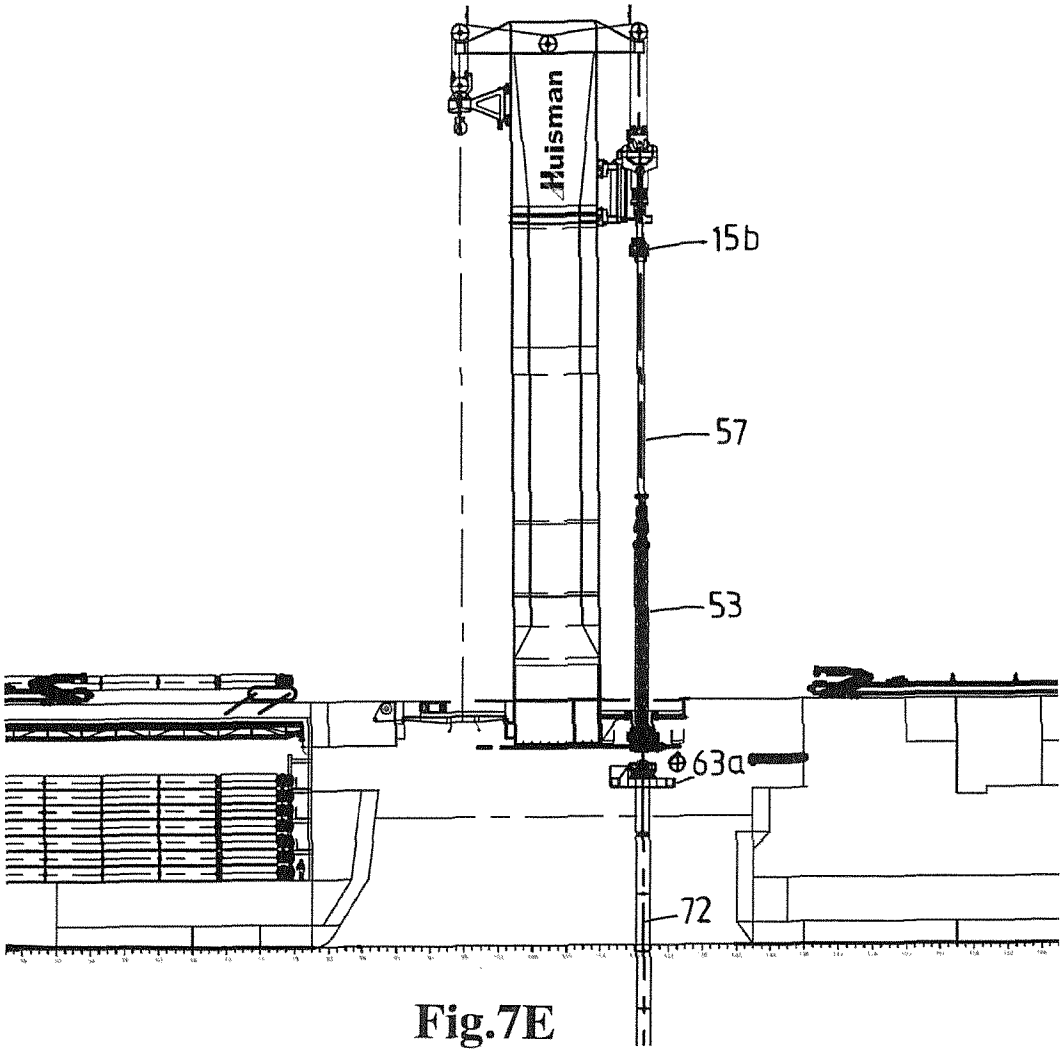
Figure 7F:
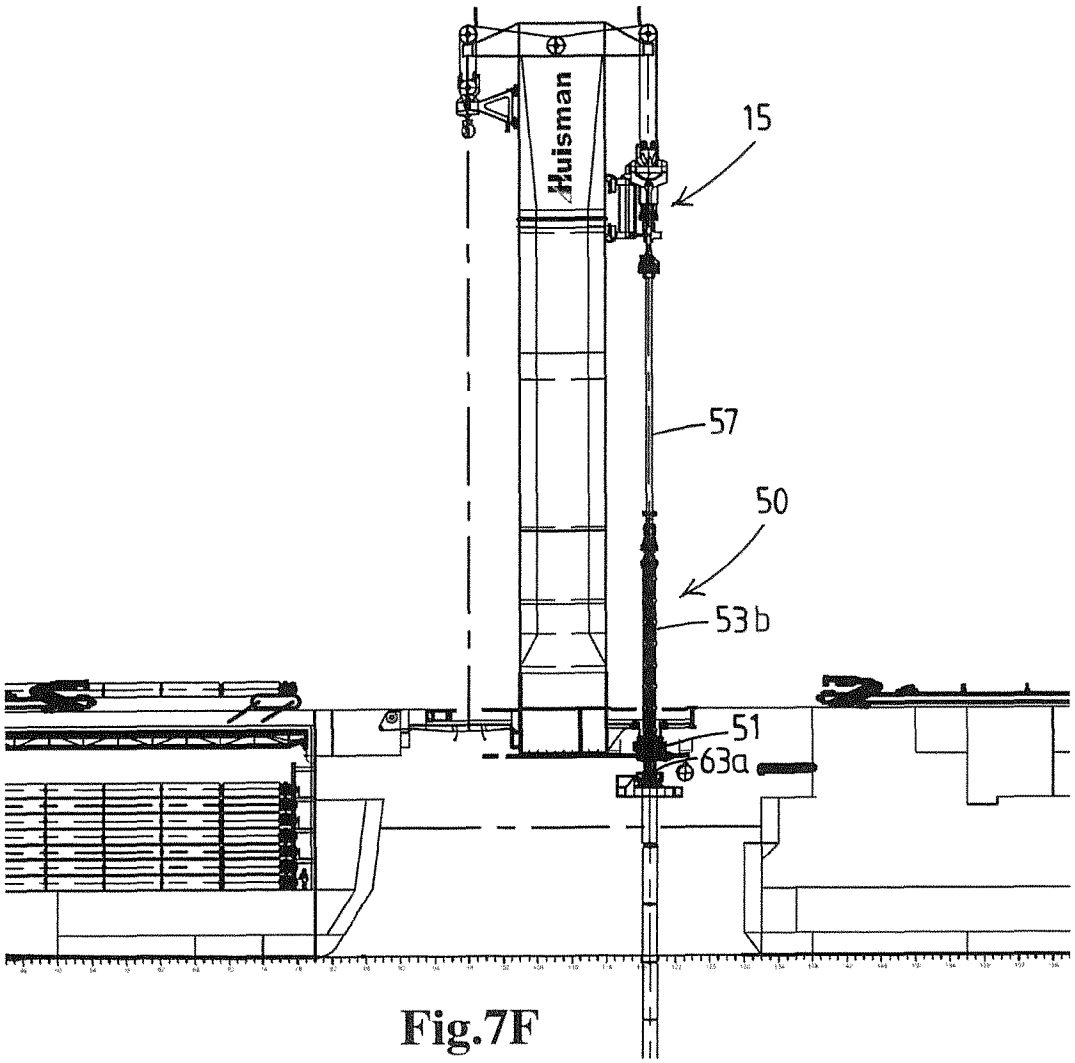
Figure 7G:
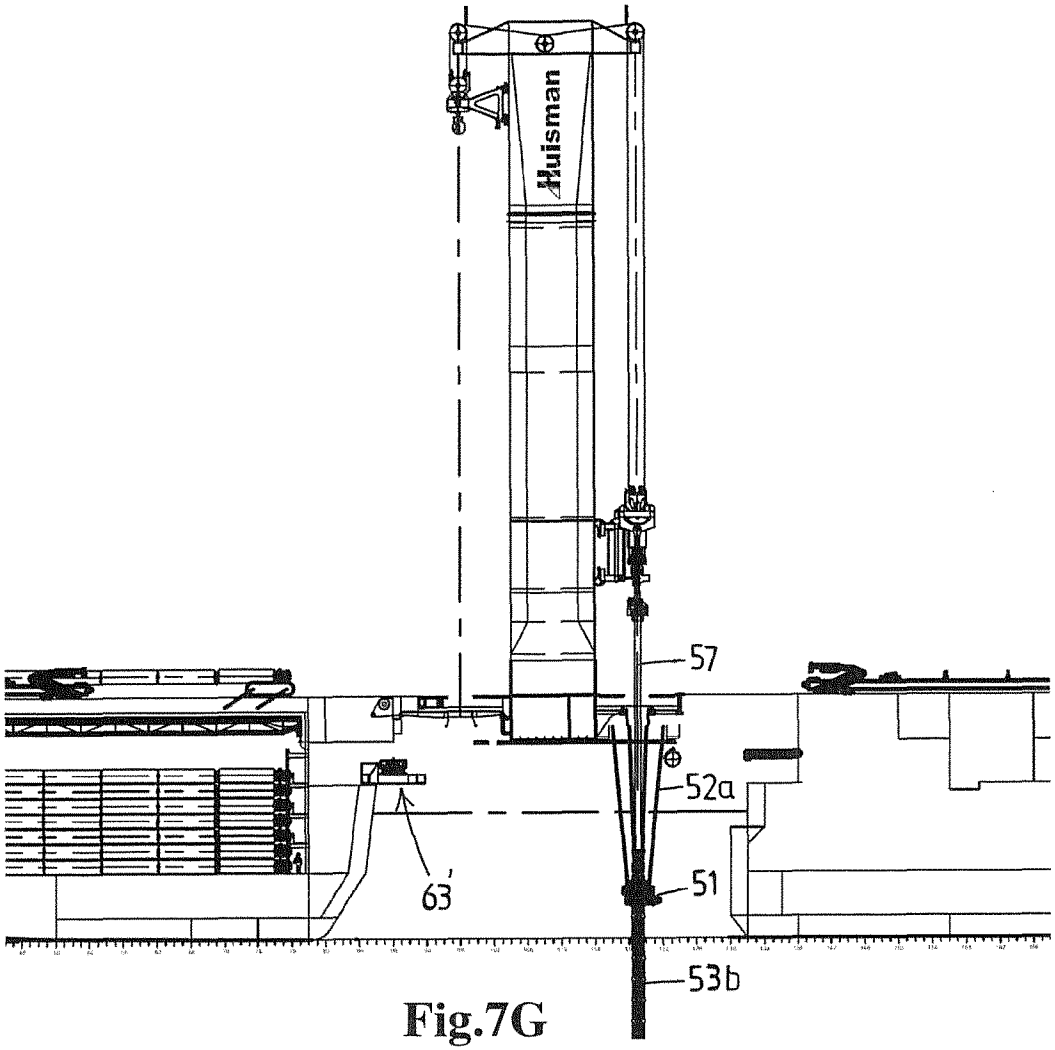
Figure 7H:
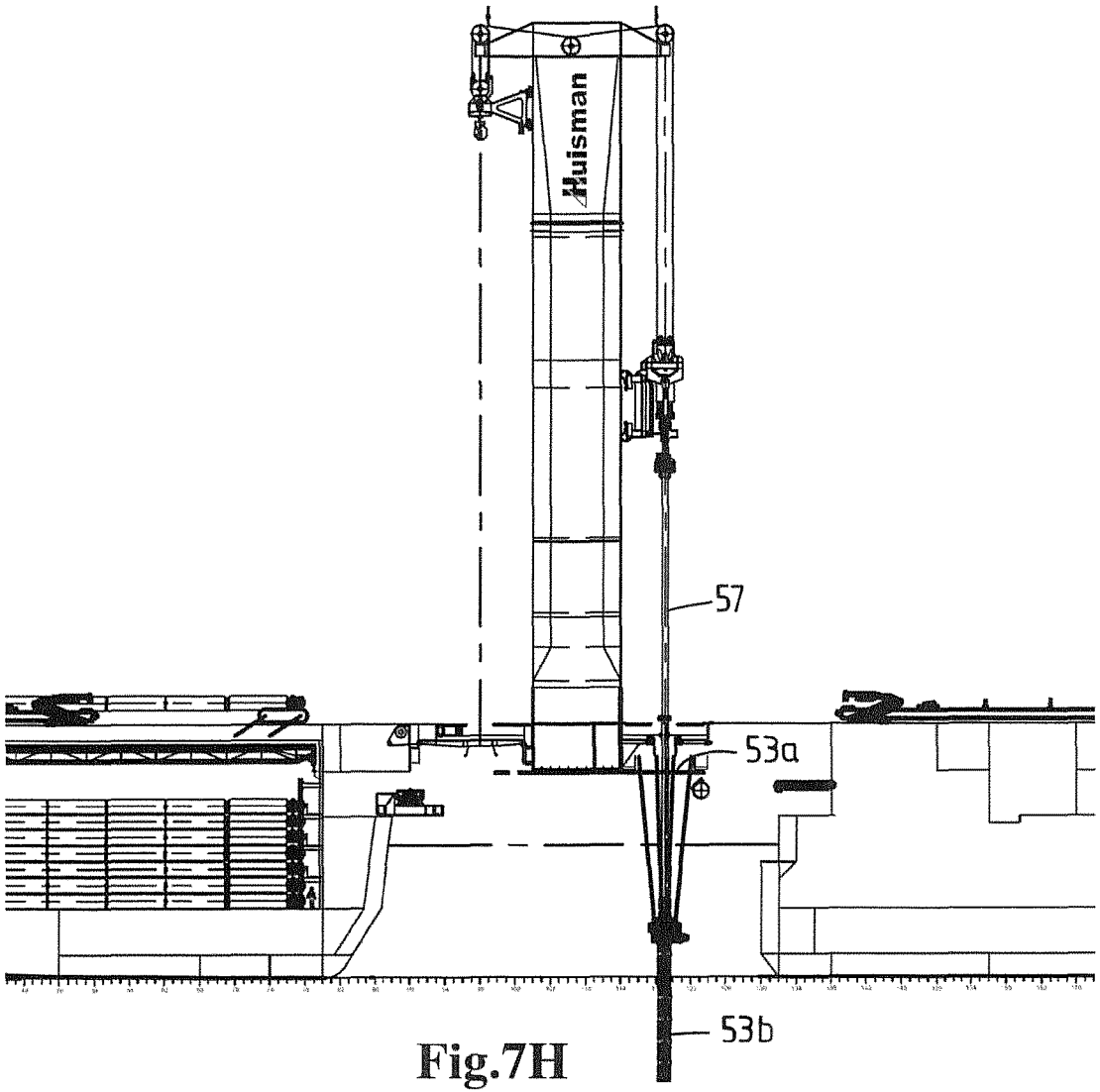
Figure 7I:
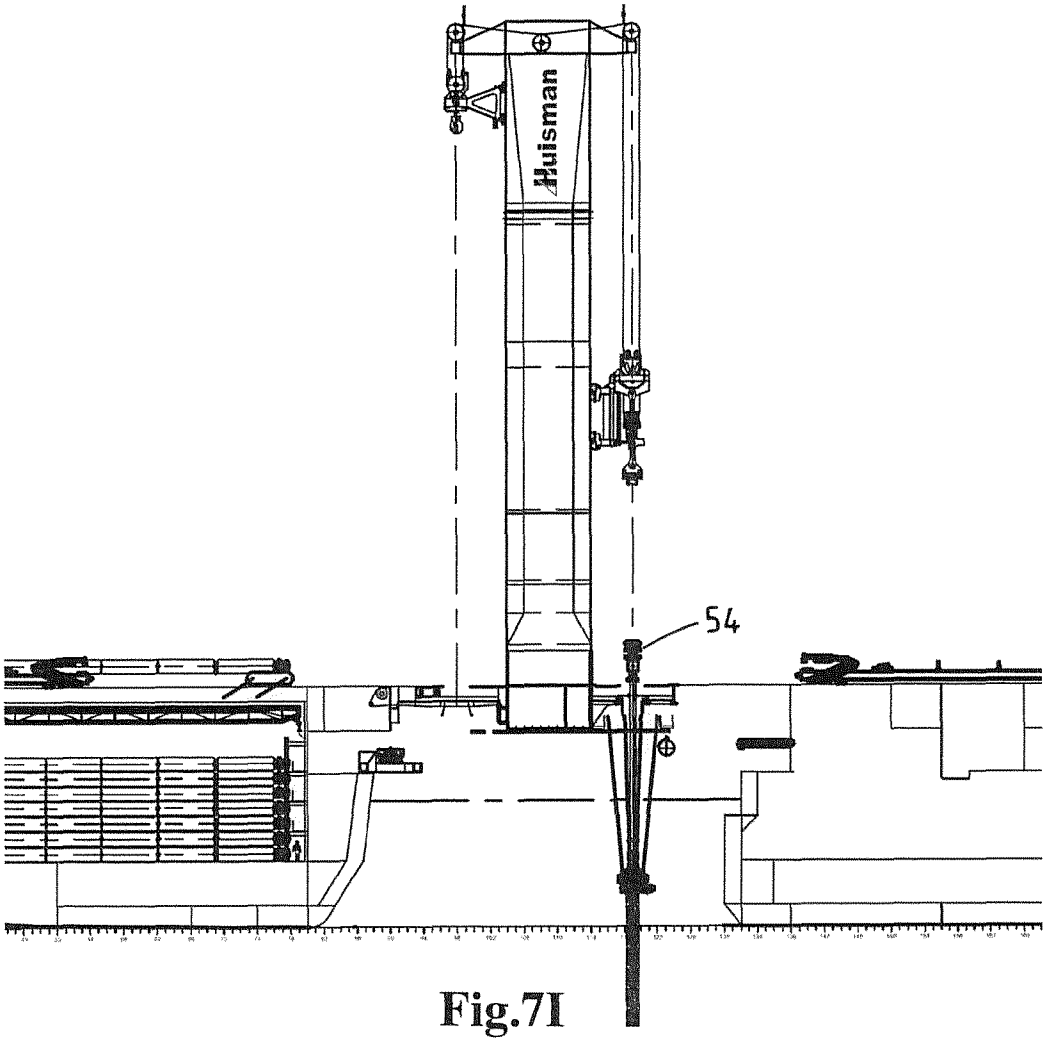
Figure 7J:
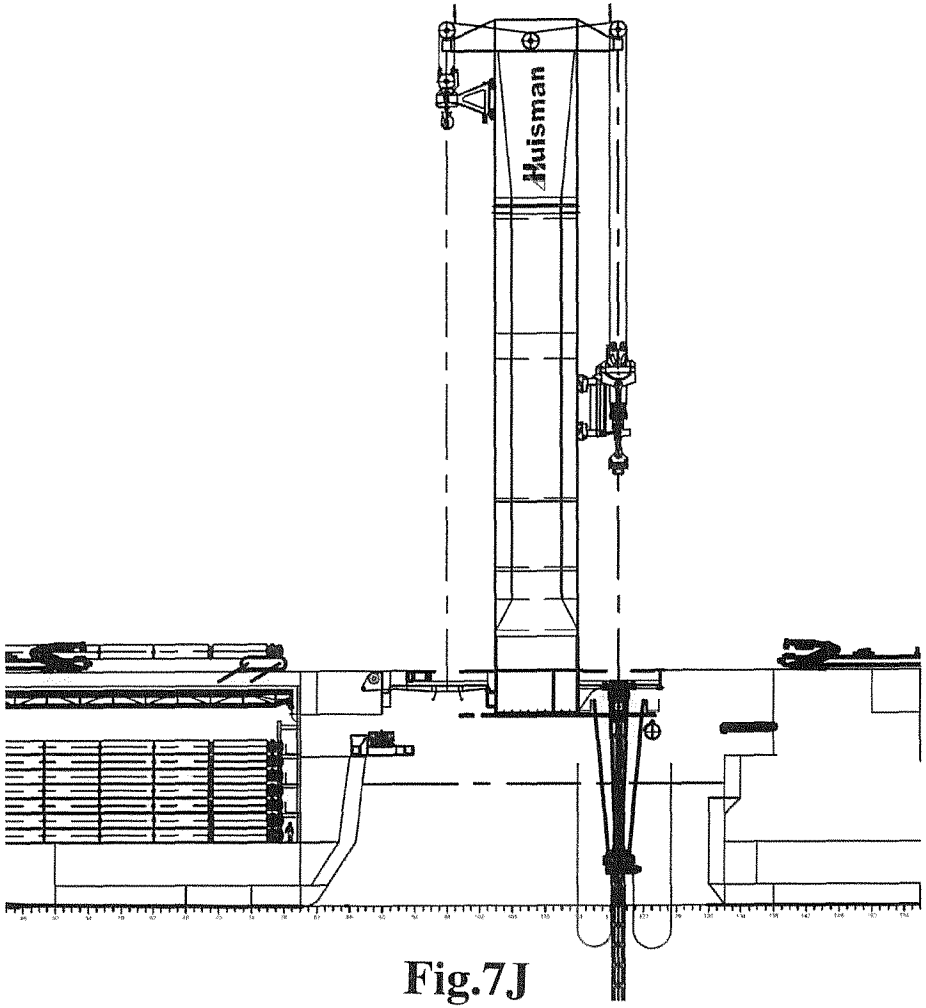
Figure 8A:
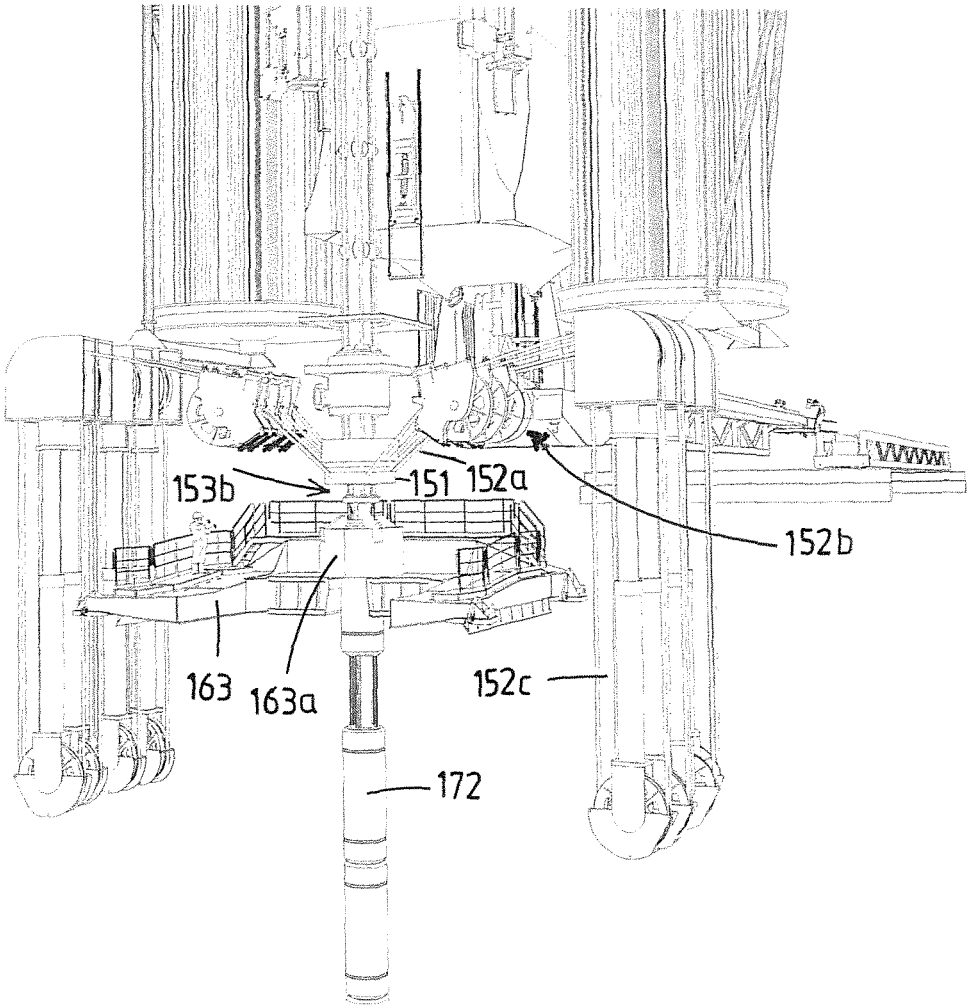

Preferred embodiments of the invention are discussed in the description with reference to the drawings. The invention will now be explained with reference to the appended drawings, in which:

FIG. 1 shows an example of an offshore drilling vessel according to the invention in a mid ship longitudinal cross-section of the vessel, prior to carrying out the method of claim 1, FIG. 2 shows the moonpool of the vessel of FIG. 1 on a larger scale, in a longitudinal cross-section of the vessel, FIGS. 3A and 3B show a top view of the suspended riser transfer device of FIG. 1, FIGS. 4A-D shows the suspended riser transfer device of FIGS. 1-3 in detail, in various views, FIGS. 5A and B show the offshore drilling vessel of FIG. 1 in a transverse cross-section of the vessel at the second firing line, prior to (FIG. 5A) and after (FIG. 5B) carrying out the method of claim 1, FIG. 6 shows the offshore drilling vessel of FIG. 1, after having carried out the method of claim 1, in a mid ship longitudinal cross-section of the vessel, FIGS. 7A-7J show a detail of the mid ship longitudinal cross-section of the vessel, wherein the method steps according to the invention are shown in succession, FIGS. 8A and B show in a perspective view steps vi) and xi) of the method of the invention.

In FIGS. 1-6 a preferred embodiment of a monohull offshore drilling vessel 1 that is suitable for offshore drilling, e.g. for oil and gas exploration, well servicing and/or other drilling related activities (e.g. servicing and/or placement of subsea equipment) is shown. The hull 2 has crew quarters and a bridge 3 on the bow side, here with helicopter platform 3*a*. Between the accommodation topside 3 and stern 6 a main deck 7 extends. In this example about halfway the length of the hull 2 the vessel 1 has a large moonpool 5.

Effectively above this moonpool 5 a multiple firing line hoist system 10 is mounted on the hull 2 so that—as preferred—a forward portion and a rear portion of the moonpool 5 are accessible at the front and the rear of the system 10. The multiple firing line hoist system 10 comprises:

a tower, here embodied as a mast 11 having a top side and a base connected to the hull of the drilling vessel, wherein the mast 11 has a hollow construction with a first side 12 (in this example the rear side) and an opposed second side 13 (in this example the front side), a first hoisting device 14 supported by the mast and having a load attachment device 14*b* displaceable along a first firing line 14*a*, which extends on the outside of and adjacent to the first side of the mast 11; the first hoisting device being adapted to build and lower a riser string in the first firing line;

a second hoisting device 15 supported by the mast and having a load attachment device 15*b* displaceable along a second firing line 15*a*, which extends on the outside of and adjacent to the second side of the mast. In the shown embodiment, the second hoisting device comprises a rotary drilling drive 15*c* in the second firing line being adapted to assemble and disassemble a drill string and effect drilling in the second firing line.

The first and second hoisting devices 14, 15 here each include one or more cables and one or more associated winches to manipulate the position of each of the first and second load attachment devices 14*b*, 15*b* relative to the mast. The winches are preferably located in the mast, most preferably in the base of the mast, but other location are also possible. Details of the mast and the hoisting devices can be derived from U.S. Pat. No. 6,763,898.

A BOP storage (not shown) is optionally present in the hull of the vessel adjacent the moonpool 5, for example at a lateral side of the moonpool. It is highly preferable that the first hoisting device 14 is adapted for raising and lowering the BOP to the seabed.

A riser storage 71 extends into the hull 2 at the rear side of the vessel. A riser manipulator 72 is arranged adjacent the firing line 14*a*, said riser manipulator 72 being adapted to receive a riser, and raise the riser so that the upper end thereof arrives in the firing line 14*a* thus allowing the upper end to be connected to the load attachment means 14 of the first hoisting device for further handling of the riser by said first hoisting means.

The vessel furthermore comprises a riser handling gantry crane 90. This riser handling gantry crane is preferably provided with riser hoisting device that allows to raise and lower a riser and displace said riser to and from the riser manipulator 72.

A mobile working deck 30 is provided at the rear side of the mast 11, which in an active position covers a portion of the moonpool 5 at said rear side of the mast 11 while the first firing line 14*a* extends through said mobile working deck (the deck has an opening 31 that can be aligned with the firing line 14*a*), and which in a non-active position is pivoted upwards about pivot 32, as also visible in FIG. 1. In this non-active position, the deck is cleared from the first firing line 14*a* and e.g. the BOP is allowed to be brought in said first firing line and manipulated by the first hoisting device.

The vessel 1 has a working deck 40, here a stationary working deck 40 at the front side of the mast 11. In the shown embodiment, the working deck 30 at the rear side of the mast is in its active position at substantially the same height as the working deck 40.

As indicated above, a rotary drilling drive 15*c* is provided at the front side of the mast, being adapted to assemble and disassemble a drill string and effect drilling at the front side of the mast. The working deck 40 has an opening 41 (visible in FIGS. 1 and 5A) for the passage of tubulars, including a telescopic joint, that can be raised and lowered with the hoisting device 15 at the front side of the mast 11.

The working deck 40 may be provided with a rotary table, an iron roughneck and/or a riser suspension device, e.g. a riser spider, allowing to suspend a riser string, most preferably with a BOP attached to the lower end of the riser string, from the deck 40. In the shown embodiment, two C-shaped clamps 42*a*, 42*b* are provided on a rail. Preferably, such a clamp 42*a*, 42*b* is suitable to support the telescopic joint. It is noted that a similar clamp is also provided in the mobile working deck 30. Furthermore, a catwalk machine is arranged in longitudinal direction to feed tubulars, e.g. drill pipes into the front firing line. A driller's cabin is arranged on the drill floor.

The mobile working deck 30, as is preferred and as shown in more detail in FIG. 2, includes a suspension device 33 arranged at the opening 31 in the deck, said suspension device 33 being adapted to connect to and support the top end of a string of tubulars 72, most preferably a riser string 72 with a BOP 75 attached to the lower end of the riser string. This suspension device 33 may include a clamping device or similar to suspend a string of tubulars from the deck, e.g. a device known as a riser spider. It will be appreciated that in this preferred embodiment the mobile working deck 30, in its active position, is capable to support the weight of the suspended string of tubulars. Preferably, the suspension device 33 comprises a gimbal device to which the clamping device is mounted, allowing a gimballing movement of the suspended riser string. Preferably, the suspension device 33 is embodied as a spider/gimbal assembly.

In a possible method, after the BOP has been lowered in the first firing line, the working deck 30 can be returned to its active position and used to suspend the BOP from the suspension device 33 of the working deck 30. Subsequently, a riser may then be connected to the top end of the BOP and the entirety lowered by means of hoisting device 14 into the sea, so that the riser top end is then suspended from the working deck 30. Then risers can be added in the manner known in the art.

At the front firing line 15*a* a riser tensioner system 50 is provided, adapted to be connected to a top end of the riser string, in order to suspend the riser string from in the second firing line. In the shown embodiment, as shown in detail in FIGS. 2, 5*a* and 5*b* the riser tensioner system 50 comprises a riser tensioner ring 51 and riser tensioners 52 connected to the vessel and supporting the riser tensioner ring 51 in the second firing line 15*a*. In particular, the riser tensioners 52 comprise cables 52*a*, sheaves 52*b* and cylinders 52*c*, wherein the cables 52*a* extend from the riser tensioner ring 51 to the cylinders 52*c* via sheaves 52*b*. Here, the riser tensioner cylinders 52*c* are provided vertically, but a configuration wherein the riser tensioner cylinders are provided horizontally is also conceivable. The riser tensioner system 50 further comprises a telescopic joint 53, which is sometimes also referred to as a slip joint, shown in detail in FIG. 5*b*, comprising an inner barrel 53*a* and an outer barrel 53*b* with a seal 53*c* therebetween, wherein the riser tensioner ring 51 is adapted to be connected to the top of the outer barrel 53*b*. Transfer hoses 56 extend from the tensioner ring to the vessel, to transfer electronics, pneumatic fluids and other fluids.

In this embodiment, the riser tensioner system 50 further comprises a top flex joint 54 above the inner barrel 53*a* of the telescopic joint, to provide lateral restraint and reduce rotation through elastomeric stiffness elements. Also a diverter 55 is located just above the top flex joint 54 and just below the drill floor 40 allowing mud with drill cuttings returning from the well through the riser to be dumped to a mud processing system.

According to the invention, the vessel 1 is furthermore equipped with a suspended riser transfer device 60. The suspended riser transfer device 60 of the present invention, shown in detail in FIGS. 2-4, includes rails 65 extending in longitudinal direction along the moonpool 5 between the first firing line 14*a* and the second firing line 15*a*, allowing to displace a frame, possibly embodied as a skid cart, in a suspended riser transfer path P in the longitudinal direction of the moonpool while supporting the riser string in a gimballing manner, in particular a riser string of interconnected risers, optionally with a BOP attached to the lower end of the riser string, lowered into the sea, generally between the rear moonpool area and the front moonpool area, so as to pass underneath the base of the mast. According to a preferred embodiment of the invention, two frames 63, 64 are provided, each supporting both a riser hang-off assembly 63*a*, 64*a* and a gimbal device 63*b*, 64*b*, to which the riser hang-off assembly 63*a*, 64*a* is mounted. The gimballing movement of the riser string is shown schematically in FIG. 1, and in FIG. 2 it is visible that both frames 63, 64 allow a gimballing motion of the riser string. In particular, in FIG. 1 two positions of a riser string 72 are shown: supported by the suspension device 33 and in a gimballing manner supported by frame 63. In FIG. 2, in addition to these two positions, the riser string 72 is also shown in a gimballing manner supported by frame 64.

Hence, when the riser string as being built in the rear firing line 14*a* has reached a sufficient length, the top end of the riser string may be lowered to the frame 63, so that the top end can be supported by the riser hang off assembly 63*a* on said frame 63. Then the frame with the suspended riser string can be moved to the front firing line 15*a*.

A frame 63 is shown in detail in FIGS. 4A-4D. The frame 64 is configured similarly. The frame 63 supports a riser hang-off assembly 63*a* being actuable between an open configuration in which the riser hang-off assembly is adapted to move around an upper end of a riser string, and a closed configuration in which the riser hang-off assembly engages and supports the riser string, leaving the top end of the riser string exposed to allow for connection to the riser tensioner system. The riser hang-off assembly as shown comprises four rams 62*c*, e.g. hydraulically actuated rams, that engage the sides of a riser string, similar to a collar clamp, leaving the top end of the riser string exposed.

The riser hang-off assembly 63*a* is mounted to a gimbal device 63*b*. The gimbal device 63*b* of the suspended riser transfer device allows for the angular motion of the riser string with respect to the riser hang-off assembly, to avoid undesirable stresses. The shown gimbal device 63*b* comprises multiple elastomeric dampeners 63*d* that absorb the loads induced by the various motions of the drilling vessel. Alternative configurations are also conceivable.

As visible in particular in the top view of FIG. 4D, and also in FIG. 3, the configuration of the frame 63, gimbal device 63*b* and riser hang-off assembly 63*a* allows opening and closing of a lock 63*e*, which is actuable between an open configuration in which the riser hang-off assembly 63*a* is adapted to move around an upper end of a riser string, and a closed configuration in which the riser hang-off assembly engages and supports the riser string.

The lock 63*e* of the shown embodiment is e.g. configured as a locking bar, or a door. In FIG. 3, the lock 64*e* of frame 64 is visible.

In FIGS. 2 and 3A, frame 63 is shown in three different positions, indicated with reference numbers 63', 63", 63"; and frame 64 is shown in two different positions, indicated with reference numbers 64', 64". The position indicated with reference number 63' is a first parking position for the frame 63, provided in the vicinity of the first firing line 14*a*, in a direction opposed to the second firing line 15*a*. The position indicated with reference number 63" is provided in the first firing line 14*a*, and the position with reference number 63'" is provided in the second firing line 15*a*. The second frame 64 is moveable between the second firing line 15*a*, via a second parking position indicated with reference number 64', to a third parking position 64". Both the second and the third parking position are provided in the vicinity of the second firing line 15*a*, in a direction opposed to the first firing line 14*a*. Accordingly, the rails 65 of the suspended riser transfer device, in the shown embodiment a pair of parallel rails, extend beyond the first firing line 14*a* to the first parking position 63' and beyond the second firing line 15*a* to the second parking position 64".

In FIGS. 3A and 3B, the moonpool 5 is shown from a top view. Where in FIG. 3A multiple positions of the frame 63 are indicated, in FIG. 3B the outline of the moonpool 5 is highlighted. Now it becomes apparent that in the shown embodiment, a string of tubulars may suspend from the frames 63, 64 in the positions 63" and 63'", corresponding to the first firing line 14*a* and second firing line 15*a*, and in the first parking position 63' and second parking position 64'. In the third parking position indicated with reference number 64", no string of tubulars is allowed to suspend from the frame.

In the shown embodiment the vessel is a monohull vessel wherein a moonpool extends having a width in the transverse direction of the hull and a length in the longitudinal direction of the hull. Here, the moonpool 5 comprises a main moonpool area 5*a* in which both firing lines extend, and in addition thereto at least one parking area, here two parking areas 5*b*, 5*c*, provided centrally at the transverse ends of the main moonpool area, the width of which does not extend over the entire width of the moonpool. This is advantageous for the overall vessel properties, such as stiffness. These parking areas allow the frames 63, 64 to park including a gimballing string of tubulars. In embodiments wherein the offshore drilling vessel is a semi-submersible, the dimension of the moonpool is generally less of an issue, and an overall increase of the dimensions of the moonpool is possible without creating such recessed parking areas 5*b*, 5*c*.

In an embodiment, not shown, a frame of the suspended riser transfer device may in addition have one or more actuable BOP support members, to directly support the BOP on the frame. This allows an alternative method, wherein it is not possible to suspend the BOP from the suspension device 33 of the working deck 30 immediately after the return of the working deck 30 to its active position, which is e.g. the case in alternative configurations of the working deck, e.g. a liftable working deck as disclosed in WO2009/102197. A direct support of the BOP on the support frame may be used for disconnecting the hoisting device 14 from the BOP after it has been lowered to be supported on the frame, so that the mobile working deck can then be returned to its active position. The BOP may then be reattached to the hoisting device and raised with its top end to the level of the working deck 30, so as to suspend the BOP from a suspension device of the working deck 30. Subsequently, similar to the above-indicated method, a riser may then be connected to the top end of the BOP and the entirety lowered by means of hoisting device 14 into the sea, so that the riser top end is then suspended from the working deck 30. Then risers can be added in the manner known in the art.

According to the invention, the offshore vessel as described in relation to the drawings 1-6 allows to build and lower the riser string 72 in the rear firing line 14*a* with the first hoisting device. When the riser string 72 has reached a sufficient length, the top end of the riser string may be lowered to the frame 63, so that the top end can be supported by the riser hang off assembly 63*a* on said frame 63. Then the frame with the suspended riser string, preferably with a BOP is moved to the front firing line 15*a*, where it is connected to the riser tensioner system 50. The operational configuration wherein the riser string 72 with BOP 75 is suspended from the riser tensioner system 50 is shown in FIG. 6. In this operational configuration, drilling can be performed through the riser string 72.

The method according to the invention is shown in detail in FIGS. 7A-7J and FIGS. 8A and 8B. Same parts are given same reference numbers as in FIGS. 1-6.

In FIG. 7A, it is visible that a BOP 75 has been lowered in the first firing line 14*a*, and that the working deck 30 has returned to its active position and is used to suspend the BOP 75 from the suspension device 33 of the working deck 30. In the embodiment of FIG. 7A, it is visible that a riser section 75*a* is connected to the BOP. A riser 72 has been retrieved from riser storage 71 and positioned in the first firing line 14*a*, and has just been connected to the top end of the BOP. In FIG. 7B the entirety of BOP 75 and riser 72 has been lowered by means of hoisting device 14 into the sea, so that the riser top end is then suspended from the working deck 30. Then risers can be added in the manner known in the art, thus building and lowering a riser string a the first side of the mast, in the first firing line.

In FIG. 7B, it can be discerned that in the second firing line, the riser tensioner system is being assembled and prepared. In particular, the riser tensioner ring 51 is positioned in the second firing line 15*a* above the rails 65 of the suspended riser transfer device, in particular above the suspended riser transfer path P, and in FIG. 7B also the picking up of a telescopic joint 53 is visible, by a catwalk or the like. In the first firing line, the riser string 72 is suspended from the first load attachment device 14*b*.

In FIG. 7C, the telescopic joint 53 is positioned in the second firing line 15*a*. In the second firing line, a clamp 42*a* for the telescopic joint is provided above the riser tensioner ring, to support the telescopic joint 53. The telescopic joint 53 extends through the riser tensioner ring 51. Furthermore, in FIG. 7C it is visible that a landing joint 57 is connected to the second load attachment device 15*b*, and is placed in the second firing line 15*a*.

The offshore vessel of the invention allows to perform actions in the first and second firing line simultaneously, and hence together with the preparation of the riser tensioner system in the second firing line, the riser hang-off assembly 63*a* is positioned in the open configuration in the first firing line 14*a*. An upper end of the riser string 72 is lowered to be positioned in the riser hang-off assembly 63*a*, which lowering is enabled by the mobile working deck 30 pivoting upwards and allowing the first hoisting device 14 to lower this top end of the riser string 72 to a level below that of the active position of the working deck, to the position in the hang-off assembly 63*a*. The riser hang-off assembly 63*a* is subsequently actuated to the closed configuration. Hereafter, the weight from the riser string 72 is transferred from the first load attachment device 14*a* to the riser hang-off assembly 63*a*.

In FIG. 7D, the landing joint 57 is connected to the telescopic joint 53 in the second firing line 15*a*. In the first firing line 14*a*, the first load attachment device 14*b* is disconnected from the riser string 72. The mobile working deck 30 is allowed to pivot back. Subsequently, the riser hang-off assembly 63*a* with frame 63 is displaced in the suspended riser transfer path on the rails while it supports the riser string 72 in a gimballing manner from the first firing line 14*a* to the second firing line 15*a*.

In FIG. 7E, in the second firing line 15*a*, the telescopic joint 53 with the landing joint 57 is lifted above the rails 65 of the suspended riser transfer device by the second hoisting device 15. Thereby, displacement of the riser hang-off assembly 63*a* with the riser string 72 into the second firing line 15*a*, below the telescopic joint 53 is allowed, as visible in FIG. 7E.

Because according to the invention the riser hang-off assembly 63*a* engages and supports the riser string 72 leaving the top end of the riser string 72 exposed, no additional handling needs to be carried out, allowing the connection of the top end of the riser string 72 to the riser tensioner system immediately after positioning the riser string in the second firing line, as visible in FIG. 7F. In particular, the telescopic joint 53 with the landing joint 57 is lowered by the second hoisting device 15 and subsequently, the top end of the riser string is connected to the lower end of the outer barrel 53*b* of the telescopic joint 53.

This is shown in a perspective view in FIG. 8A, wherein the top end of a riser 172 is supported by a hang-off assembly 163*a*. Hang-off assembly 163*a* is supported by a frame 163, which is displaceable along rails, not shown. The top end of the riser 172 is connected to the lower end of an outer barrel 153*b* of a telescopic joint 153. Hereby the riser 172 extends through the tensioner ring 151, which is connected via cables 152*a* and sheaves 152*b* to riser tensioner cylinders 152*c*.

In FIG. 7G, the step of transferring the weight from the riser string 72 from the riser hang-off assembly 63*a* to the riser tensioner system has been performed. In particular, the weight from the riser string 72 is transferred from the riser hang-off assembly 63*a* to the telescopic joint 53, which is still supported via landing joint 57 by the second hoist assembly 15. After the weight has been transferred, the riser hang-off assembly 63*a* is actuated to the open configuration and thus allowing the disconnection of the riser hang-off assembly 63*a* from the riser string 72. Hereafter, the riser hang-off assembly 63*a* with frame 63 is displaced in longitudinal direction of the moonpool from the second firing line 15*a* to a parking position 63' beyond the first firing line 14*a*. In the second firing line 15*a*, the second hoisting device 15 lowers the telescopic joint 53 with the landing joint 57 further, and connects the riser tensioner ring 51 to a top of the outer barrel 53*b* of the telescopic joint. In FIG. 7G, the telescopic joint 53 is lowered even further with the landing joint 57 by the second hoisting device 15, until the weight of the telescopic joint 53 and the suspended riser 72 is supported by the riser tensioners 52. In particular, the taut cables 52*a* are visible in FIG. 7G.

Figure 8B:
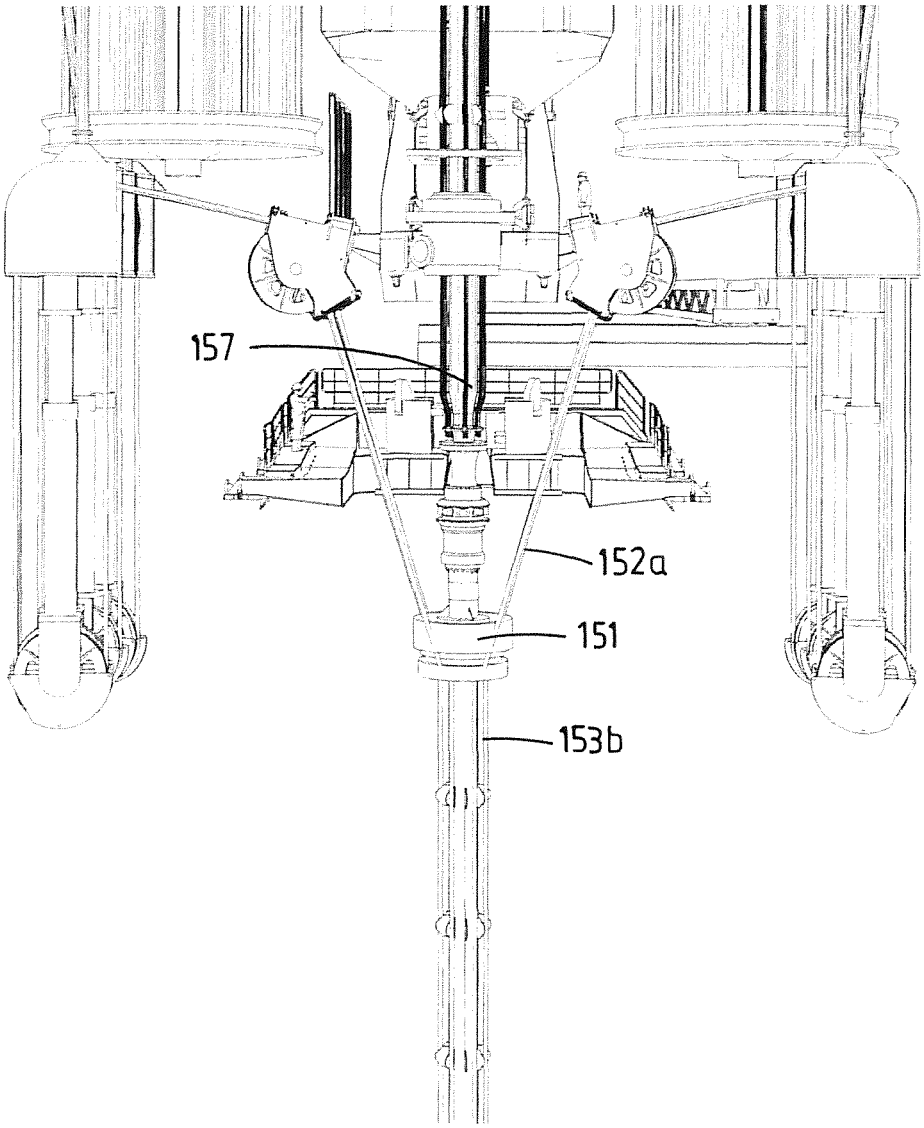

The same situation is depicted in a perspective view in FIG. 8B, in which the outer barrel 153*b* of the telescopic joint is connected to the riser tensioner ring 151, which is allowed to be lowered until the cables 152 of the riser tensioner system are taut. The telescopic joint is still connected to a landing joint 157.

In FIG. 7H, it is visible that the inner barrel 53*a* of the telescopic joint 53 is raised out of the outer barrel 53*b*, with the landing joint 57 by the second hoisting device 15.

In FIG. 7I, the landing joint 57 is disconnected from the second load attachment device 15 and from the telescopic joint 53. The weight of the telescopic joint 53 and the suspended riser 72 is fully supported by the riser tensioners 52. Now that the top end of the telescopic joint 53 is free, in the shown embodiment a flex joint 54 is mounted to the telescopic joint, as well as a diverter connection to be connected to the diverter 55, mounted in the vessel.

The assembled operational configuration is shown in FIG. 7J. The second hoisting device is used to further lower the flex joint 54. The situation of FIG. 7J corresponds to the configuration as shown in FIG. 5B and FIG. 6.

The invention claimed is:

1. A method for riser string handling on an offshore drilling vessel, the offshore drilling vessel comprising:

a hull having a moonpool extending through the hull;

a multiple firing line hoist system mounted on the hull at said moonpool, the multiple firing line hoist system comprising:

a tower having a top side and a base connected to the hull of the drilling vessel;

a first hoisting device supported by the tower and having a first load attachment device displaceable along a first firing line, which extends essentially parallel to the tower; the first hoisting device being adapted to build and lower a riser string in the first firing line;

a second hoisting device supported by the tower and having a second load attachment device displaceable along a second firing line, which extends essentially parallel to the tower; wherein a rotary drilling drive is provided in the second firing line, being adapted to assemble and disassemble a drill string and effect drilling in the second firing line;

a riser tensioner system arranged in the second firing line, adapted to be connected to a top end of the riser string, in order to suspend the riser string from in the second firing line;

a suspended riser transfer device, comprising:

a riser hang-off assembly being actuable between an open configuration in which the riser hang-off assembly is adapted to move around an upper end of the riser string, and a closed configuration in which the riser hang-off assembly engages and supports the riser string, leaving the top end of the riser string exposed to allow for connection to the riser tensioner system;

a frame with a gimbal device, to which the riser hang-off assembly is mounted; and rails extending in a longitudinal direction along the moonpool between the first firing line and the second firing line, allowing to displace the frame in a suspended riser transfer path in a longitudinal direction of the moonpool while the riser string is supported by the gimbal device, wherein a first parking position for the frame of the suspended riser transfer device of the offshore drilling vessel is provided in the vicinity of the first firing line, in a direction opposed to the second firing line, and wherein the rails of the suspended riser transfer device extend beyond the first firing line to the first parking position, wherein a second parking position for the frame of the suspended riser transfer device of the offshore drilling vessel is provided in the vicinity of the second firing line, in a direction opposed to the first firing line, and wherein the rails of the suspended riser transfer device extend beyond the second firing line to the second parking position, and wherein the suspended riser transfer device of the offshore drilling vessel further comprises:

a second riser hang-off assembly being actuable between an open configuration in which the second riser hang-off assembly is adapted to move around an upper end of a second riser string of interconnected risers, and a closed configuration in which the riser hang-off assembly engages and supports the second riser string, leaving a top end of the second riser string exposed to allow for connection to the riser tensioner system;

a second gimbal device, to which the second riser hang-off assembly is mounted, and a second frame supporting both the second riser hang-off assembly and the second gimbal device, the method comprising the following steps:

a) building and lowering the riser string in the first firing line, and simultaneously assembling and preparing the riser tensioner system in the second firing line;

b) suspending the riser string from the first load attachment device;

c) positioning the riser hang-off assembly in the open configuration in the first firing line;

d) positioning the upper end of the riser string in the riser hang-off assembly and actuating the riser hang-off assembly to the closed configuration;

e) transferring the weight of the riser string from the first load attachment device to the riser hang-off assembly;

f) disconnecting the first load attachment device from the riser string;

g) displacing the riser hang-off assembly in the suspended riser transfer path while the riser hang-off assembly supports the riser string in the gimbal device from the first firing line to the second firing line;

h) connecting the top end of the riser string to the riser tensioner system;

i) transferring the weight of the riser string from the riser hang-off assembly to the riser tensioner system;

j) actuating the riser hang-off assembly to the open configuration and thus disconnecting the riser hang-off assembly from the riser string; and k) displacing the riser hang-off assembly in the suspended riser transfer path from the second firing line to the first firing line.

2. The method according to claim 1, wherein the riser tensioner system of the offshore drilling vessel comprises:

a riser tensioner ring;

riser tensioners connected to the vessel and supporting the riser tensioner ring in the second firing line;

a telescopic joint comprising an inner barrel and an outer barrel with a seal therebetween, wherein the riser tensioner ring is adapted to be connected to a top of the outer barrel; and a landing joint, and wherein in the second firing line a clamp for the telescopic joint is provided above the riser tensioner ring, and wherein the method further comprises the following steps:

i. positioning the riser tensioner ring in the second firing line above the suspended riser transfer path;

ii. positioning the telescopic joint in the clamp in the second firing line;

iii. connecting the landing joint to the second load attachment device and the telescopic joint;

iv. lifting the telescopic joint with the landing joint by the second hoisting device to a level above the suspended riser transfer device, allowing the telescopic joint to be connected to the exposed top end of the riser string;

v. displacing the riser hang-off assembly in the suspended riser transfer path while the riser hang-off assembly supports the riser string in the gimbal device from the first firing line to the second firing line;

vi. lowering the telescopic joint with the landing joint by the second hoisting device and connecting the top end of riser string to the lower end of the outer barrel of the telescopic joint;

vii. transferring the weight of the riser string from the riser hang-off assembly to the telescopic joint;

viii. actuating the riser hang-off assembly to the open configuration and thus disconnecting the riser hang-off assembly from the riser string;

ix. displacing the riser hang-off assembly from the second firing line to the first firing line in the suspended riser transfer path;

x. further lowering the telescopic joint with the landing joint by the second hoisting device and connecting the riser tensioner ring to the top of the outer barrel of the telescopic joint;

xi. further lowering the telescopic joint with the landing joint by the second hoisting device until the weight of the telescopic joint and suspended riser is supported by the riser tensioners;

xii. raising the inner barrel of the telescopic joint with the landing joint by the second hoisting device; and xiii. disconnecting the landing joint from the second load attachment device and from the telescopic joint.

3. The method according to claim 1, wherein the hull of the offshore drilling vessel is a monohull with a bow and a stern, wherein an accommodation topside having crew quarters and a bridge is arranged on the hull at the bow, and wherein a main deck extends between the accommodation topside and the stern of the vessel.

4. The method according to claim 1, wherein the offshore drilling vessel is a semi-submersible having a deck box structure support by legs on parallel pontoons.

5. An offshore drilling vessel comprising:

a hull having a moonpool extending through the hull; and a multiple firing line hoist system mounted on the hull at said moonpool, the multiple firing line hoist system comprising:

a tower having a top side and a base connected to the hull of the drilling vessel;

a first hoisting device supported by the tower and having a first load attachment device displaceable along a first firing line, which extends essentially parallel to the tower; the first hoisting device being adapted to build and lower a riser string in the first firing line; and a second hoisting device supported by the tower and having a second load attachment device displaceable along a second firing line, which extends essentially parallel to the tower; wherein a rotary drilling drive is provided in the second firing line, being adapted to assemble and disassemble a drill string and effect drilling in the second firing line;

a riser tensioner system arranged in the second firing line, adapted to be connected to a top end of the riser string, in order to suspend the riser string from in the second firing line; and a suspended riser transfer device, comprising:

a first riser hang-off assembly being actuable between an open configuration in which the riser hang-off assembly is adapted to move around an upper end of the riser string, and a closed configuration in which the first riser hang-off assembly engages and supports the riser string, leaving the top end of the riser string exposed to allow for connection to the riser tensioner system;

a first gimbal device, to which the first riser hang-off assembly is mounted;

a first frame supporting both the first riser hang-off assembly and the first gimbal device;

a second riser hang-off assembly being actuable between an open configuration in which the riser hang-off assembly is adapted to move around an upper end of a second riser string, and a closed configuration in which the second riser hang-off assembly engages and supports the second riser string, leaving the top end of the second riser string exposed to allow for connection to the riser tensioner system;

a second gimbal device, to which the second riser hang-off assembly is mounted;

a second frame supporting both the second riser hang-off assembly and the second gimbal device, wherein a first parking position for the second frame is provided in the vicinity of the first firing line, in a direction opposed to the second firing line, and wherein a second parking position for the second frame is provided in the vicinity of the second firing line, in a direction opposed to the first firing line; and rails extending in a longitudinal direction along the moonpool from the first parking position beyond the first firing line, via the first firing line and the second firing line, to the second parking position beyond the second firing line, the rails allowing to displace the second frame in a suspended riser transfer path in the longitudinal direction of the moonpool while the second riser string is supported by the second gimbal device.

6. The offshore drilling vessel according to claim 5, wherein the vessel is a monohull vessel, wherein the moonpool extends having a width in the transverse direction of the hull and a length in the longitudinal direction of the hull, wherein the moonpool comprises a main moonpool area in which both firing lines extend, and in addition thereto at least one parking area, provided centrally at a transverse end of the main moonpool area, the width of which does not extend over the entire width of the moonpool.

* * * * *